US009475623B2

(12) United States Patent
Vogel et al.

(10) Patent No.: US 9,475,623 B2
(45) Date of Patent: Oct. 25, 2016

(54) CLOSURE FOR A CONTAINER

(71) Applicant: Gateway Plastics, Inc., Mequon, WI (US)

(72) Inventors: William C. Vogel, Mequon, WI (US); Terrence M. Parve, Menomonee Falls, WI (US); Robert E. Proudfoot, West Bend, WI (US)

(73) Assignee: GATEWAY PLASTICS, INC., Mequon, WI (US)

( * ) Notice: Subject to any disclaimer, the term of this patent is extended or adjusted under 35 U.S.C. 154(b) by 0 days.

(21) Appl. No.: 14/588,733

(22) Filed: Jan. 2, 2015

(65) Prior Publication Data

US 2015/0114964 A1 Apr. 30, 2015

Related U.S. Application Data

(63) Continuation-in-part of application No. 13/429,747, filed on Mar. 26, 2012, now Pat. No. 8,955,705.

(51) Int. Cl.

| | |
|---|---|
| ***B65D 51/20*** | (2006.01) |
| ***B65D 47/26*** | (2006.01) |
| ***B65D 21/02*** | (2006.01) |
| *B65D 51/18* | (2006.01) |

(52) U.S. Cl.
CPC ..... *B65D 47/265* (2013.01); *B65D 21/0223* (2013.01)

(58) Field of Classification Search
CPC B65D 47/2012; B65D 51/18; B65D 47/265; B65D 21/0223
USPC ..... 220/253, 258.3, 254.4; 222/480, 482
See application file for complete search history.

(56) References Cited

U.S. PATENT DOCUMENTS

| | | | |
|---|---|---|---|
| 847,726 | A | 3/1907 | Brannon |
| 1,820,817 | A | 8/1931 | Mcrae |
| 2,102,440 | A | 12/1937 | Sebell |
| 2,108,063 | A | 2/1938 | Hothersall |
| D120,154 | S | 4/1940 | Carson |
| D120,155 | S | 4/1940 | Carson |
| D136,002 | S | 7/1943 | Mas |
| 2,687,157 | A | 8/1954 | Cowan |

(Continued)

FOREIGN PATENT DOCUMENTS

| | | |
|---|---|---|
| CA | 1245601 | 11/1988 |
| CH | 491014 | 7/1970 |

(Continued)

*Primary Examiner* — J. Gregory Pickett
*Assistant Examiner* — Niki M Eloshway
(74) *Attorney, Agent, or Firm* — Foley & Lardner LLP

(57) ABSTRACT

A closure includes a body having an open bottom formed of a skirt that defines an outer periphery of the body and an end wall defining a body dispensing aperture and a raised body portion providing a closed barrier. The closure also includes a cover coupled to the end wall of the body and having a cover dispensing aperture, the cover being rotatably movable relative to the body between a dispensing position with the cover dispensing aperture substantially aligned with the body dispensing aperture, and a closed position with the cover dispensing aperture substantially aligned with the raised body portion, wherein the cover dispensing aperture includes one or more dividers defining sub-apertures, and wherein each of the one or more dividers includes a flat top surface and extends away from the flat surface to form a pointed bottom edge that projects toward the open bottom of the body.

20 Claims, 16 Drawing Sheets

(56) References Cited

U.S. PATENT DOCUMENTS

| | | | |
|---|---|---|---|
| 2,778,533 | A | 1/1957 | Savary |
| 2,796,191 | A | 6/1957 | Belanger |
| 2,826,343 | A | 3/1958 | Albiani |
| 2,894,654 | A | 7/1959 | Lohrer |
| 2,961,133 | A | 11/1960 | Ankney |
| 3,013,308 | A | 12/1961 | Armour |
| 3,018,931 | A | 1/1962 | Westgate |
| 3,033,407 | A | 5/1962 | Isele-Aregger |
| D193,121 | S | 6/1962 | Wickman |
| 3,059,816 | A | 10/1962 | Goldstein |
| 3,110,410 | A | 11/1963 | Pehr |
| 3,115,994 | A | 12/1963 | Grady |
| 3,117,701 | A | 1/1964 | Stull |
| 3,131,824 | A | 5/1964 | Van Baarn |
| 3,135,456 | A | 6/1964 | Palazzolo |
| 3,143,256 | A | 8/1964 | Lazure et al. |
| 3,155,285 | A | 11/1964 | Van Baam |
| D200,270 | S | 2/1965 | Waterman |
| 3,180,537 | A | 4/1965 | Collins |
| 3,181,746 | A | 5/1965 | Tupper |
| D204,509 | S | 4/1966 | Waterman |
| 3,262,606 | A | 7/1966 | Waterman |
| 3,322,308 | A | 5/1967 | Foster |
| 3,323,671 | A | 6/1967 | Minarik et al. |
| 3,351,242 | A | 11/1967 | Lodding, et al. |
| 3,412,890 | A | 11/1968 | Rich |
| 3,486,665 | A | 12/1969 | Lacroce |
| 3,499,588 | A | 3/1970 | Bartilson et al. |
| 3,542,235 | A | 11/1970 | Hidding |
| 3,563,426 | A | 2/1971 | Bartilson |
| 3,629,901 | A | 12/1971 | Wolf |
| 3,651,992 | A | 3/1972 | Hazard |
| 3,675,812 | A | 7/1972 | Foster |
| 3,782,583 | A | 1/1974 | Abbey |
| 3,851,812 | A | 12/1974 | Bittel |
| 3,860,135 | A | 1/1975 | Yung et al. |
| 3,881,639 | A | 5/1975 | Herip |
| 3,907,156 | A | 9/1975 | Weatherhead, III |
| 3,912,128 | A | 10/1975 | Ziemann et al. |
| 3,933,271 | A | 1/1976 | McGhie |
| 3,948,415 | A | 4/1976 | Debenham |
| 3,966,080 | A | 6/1976 | Bittel |
| 3,998,354 | A | 12/1976 | Song |
| 4,022,352 | A | 5/1977 | Pehr |
| 4,029,202 | A | 6/1977 | Lasich et al. |
| 4,040,595 | A | 8/1977 | Tecco |
| 4,082,201 | A | 4/1978 | Bittel |
| 4,106,672 | A | 8/1978 | Tecco et al. |
| 4,127,221 | A | 11/1978 | Vere |
| 4,163,496 | A | 8/1979 | Dogliotti |
| 4,170,315 | A | 10/1979 | Dubach et al. |
| 4,177,932 | A | 12/1979 | Cleevely |
| 4,183,457 | A | 1/1980 | Loughley et al. |
| 4,223,814 | A | 9/1980 | Sneider |
| 4,236,653 | A | 12/1980 | Gach |
| D258,052 | S | 1/1981 | Firanzi |
| 4,253,587 | A | 3/1981 | Otterson |
| D258,869 | S | 4/1981 | Firanzi |
| 4,274,563 | A | 6/1981 | Otterson |
| 4,280,636 | A | 7/1981 | Lewis |
| 4,284,200 | A | 8/1981 | Bush et al. |
| 4,291,818 | A | 9/1981 | Nozawa et al. |
| 4,308,979 | A | 1/1982 | Otterson |
| 4,326,649 | A | 4/1982 | Marino et al. |
| D265,060 | S | 6/1982 | Blank |
| 4,334,639 | A | 6/1982 | Gach |
| D266,390 | S | 10/1982 | Haner |
| 4,359,171 | A | 11/1982 | Lewis |
| 4,361,250 | A | 11/1982 | Foster |
| 4,369,901 | A | 1/1983 | Hidding |
| D268,482 | S | 4/1983 | Mineo |
| 4,380,307 | A | 4/1983 | Stillinger |
| 4,403,712 | A | 9/1983 | Wiesinger |
| 4,414,705 | A | 11/1983 | Ostrowsky |
| D272,807 | S | 2/1984 | Ruhl |
| 4,457,458 | A | 7/1984 | Heinol |
| 4,489,864 | A | 12/1984 | Davis |
| D276,981 | S | 1/1985 | Cleevely |
| D277,458 | S | 2/1985 | Neggers |
| 4,503,991 | A | 3/1985 | Joyce |
| D278,602 | S | 4/1985 | Rosenstein |
| 4,533,058 | A | 8/1985 | Uhlig |
| 4,538,731 | A | 9/1985 | Cillario |
| 4,541,541 | A | 9/1985 | Hickman et al. |
| 4,545,495 | A | 10/1985 | Kinsley |
| 4,545,508 | A | 10/1985 | Cribb et al. |
| 4,573,600 | A | 3/1986 | Dubach |
| 4,610,371 | A | 9/1986 | Karkiewicz |
| 4,611,725 | A | 9/1986 | Kacalieff |
| 4,629,081 | A | 12/1986 | McLaren |
| 4,643,881 | A | 2/1987 | Alexander et al. |
| 4,648,528 | A | 3/1987 | LaBarge et al. |
| 4,658,980 | A | 4/1987 | Lindstrom |
| D291,411 | S | 8/1987 | Crawford |
| 4,693,399 | A | 9/1987 | Hickman et al. |
| D292,882 | S | 11/1987 | Gross |
| 4,714,181 | A | 12/1987 | Kozlowski et al. |
| 4,718,567 | A | 1/1988 | La Vange |
| 4,723,693 | A | 2/1988 | DeCoster |
| 4,724,977 | A | 2/1988 | Cleevely et al. |
| 4,726,091 | A | 2/1988 | Joyce |
| 4,730,731 | A | 3/1988 | Allison |
| 4,733,794 | A | 3/1988 | Kent |
| 4,735,334 | A | 4/1988 | Abbott |
| 4,735,335 | A | 4/1988 | Torterotot |
| 4,739,906 | A | 4/1988 | LoTurco |
| D296,081 | S | 6/1988 | Kuboshima |
| 4,778,071 | A | 10/1988 | Fillmore |
| 4,792,054 | A | 12/1988 | Weidman |
| 4,793,501 | A | 12/1988 | Beck |
| 4,793,502 | A | 12/1988 | Beck |
| 4,813,560 | A | 3/1989 | Begley |
| 4,823,995 | A | 4/1989 | Lewis |
| 4,838,441 | A | 6/1989 | Chernack |
| 4,848,612 | A | 7/1989 | Beck |
| 4,854,473 | A | 8/1989 | Dubach |
| 4,881,668 | A | 11/1989 | Kitterman et al. |
| D305,206 | S | 12/1989 | Hickman et al. |
| 4,898,292 | A | 2/1990 | VerWeyst et al. |
| D306,701 | S | 3/1990 | Beck |
| 4,915,268 | A | 4/1990 | Lay et al. |
| 4,919,286 | A | 4/1990 | Agbay, Sr. |
| 4,936,494 | A | 6/1990 | Weidman |
| 4,940,167 | A | 7/1990 | Fillmore et al. |
| 4,955,513 | A | 9/1990 | Bennett |
| 4,984,716 | A | 1/1991 | Beck |
| 4,993,606 | A | 2/1991 | Bolen et al. |
| D315,307 | S | 3/1991 | Kanyer |
| 5,007,555 | A | 4/1991 | Beck |
| 5,020,686 | A | 6/1991 | Dutt |
| D318,778 | S | 8/1991 | Fiore et al. |
| 5,042,658 | A | 8/1991 | Tiramani et al. |
| 5,048,730 | A | 9/1991 | Forsyth et al. |
| D320,746 | S | 10/1991 | Bolen et al. |
| D321,137 | S | 10/1991 | Hofmann et al. |
| 5,067,624 | A | 11/1991 | Thanisch |
| 5,083,671 | A | 1/1992 | Hayes |
| 5,085,331 | A | 2/1992 | Groya et al. |
| 5,115,931 | A | 5/1992 | Dubach |
| 5,139,165 | A | 8/1992 | Hara |
| 5,143,234 | A | 9/1992 | Lohrman et al. |
| D331,877 | S | 12/1992 | Robichaud et al. |
| D331,878 | S | 12/1992 | Forsyth |
| 5,167,338 | A | 12/1992 | Kick |
| D333,617 | S | 3/1993 | Brown |
| 5,193,704 | A | 3/1993 | Kick |
| 5,205,430 | A | 4/1993 | Valyi |
| 5,211,301 | A | 5/1993 | Groya et al. |
| 5,219,100 | A | 6/1993 | Beck et al. |
| D339,065 | S | 9/1993 | Forsyth et al. |
| D340,187 | S | 10/1993 | Forsyth |
| D340,188 | S | 10/1993 | Forsyth |
| 5,249,695 | A | 10/1993 | Luch et al. |
| 5,269,432 | A | 12/1993 | Beckertgis |

(56) References Cited

U.S. PATENT DOCUMENTS

| | | | |
|---|---|---|---|
| 5,271,519 | A | 12/1993 | Adams et al. |
| 5,305,931 | A | 4/1994 | Martin et al. |
| D346,958 | S | 5/1994 | Olson |
| D347,974 | S | 6/1994 | McBride |
| 5,330,082 | A | 7/1994 | Forsyth |
| 5,339,993 | A | 8/1994 | Groya et al. |
| 5,348,183 | A | 9/1994 | Luch et al. |
| 5,356,017 | A | 10/1994 | Rohr et al. |
| 5,377,882 | A | 1/1995 | Pham et al. |
| 5,383,582 | A | 1/1995 | Baxter et al. |
| D355,121 | S | 2/1995 | Kohl |
| 5,386,918 | A | 2/1995 | Neveras et al. |
| 5,397,013 | A | 3/1995 | Adams et al. |
| 5,423,442 | A | 6/1995 | Nozawa et al. |
| 5,435,456 | A | 7/1995 | Dubach |
| D361,512 | S | 8/1995 | Dalmaz |
| 5,489,035 | A | 2/1996 | Fuchs |
| 5,499,736 | A | 3/1996 | Kohl |
| 5,501,348 | A | 3/1996 | Takeuchi |
| 5,509,582 | A | 4/1996 | Robbins, III |
| 5,531,349 | A | 7/1996 | Wojcik et al. |
| 5,540,343 | A | 7/1996 | Schumacher |
| 5,542,579 | A | 8/1996 | Robbins, III |
| 5,558,239 | A | 9/1996 | Dubach |
| 5,566,850 | A | 10/1996 | Forsyth et al. |
| 5,579,957 | A | 12/1996 | Gentile et al. |
| 5,588,546 | A | 12/1996 | Farside |
| 5,603,421 | A | 2/1997 | Opresco |
| 5,620,107 | A | 4/1997 | Takeuchi |
| 5,632,417 | A | 5/1997 | Robbins et al. |
| 5,642,824 | A | 7/1997 | Hess et al. |
| 5,667,089 | A | 9/1997 | Moore |
| 5,667,094 | A | 9/1997 | Rapchak et al. |
| D385,791 | S | 11/1997 | Forsyth et al. |
| 5,738,236 | A | 4/1998 | Brun, Jr. |
| 5,755,352 | A | 5/1998 | Wojcik et al. |
| 5,758,793 | A | 6/1998 | Forsyth et al. |
| 5,762,216 | A | 6/1998 | Takeuchi |
| 5,785,193 | A | 7/1998 | Kobayashi et al. |
| 5,799,838 | A | 9/1998 | Miller |
| 5,823,345 | A | 10/1998 | Nask et al. |
| D404,201 | S | 1/1999 | Wennerstrom |
| 5,865,353 | A | 2/1999 | Baudin |
| 5,875,907 | A | 3/1999 | Lay |
| 5,908,125 | A | 6/1999 | Opresco |
| 5,913,435 | A | 6/1999 | Fuchs |
| D413,064 | S | 8/1999 | Bansal |
| D414,698 | S | 10/1999 | Mogard et al. |
| 5,971,231 | A | 10/1999 | Samz et al. |
| 5,975,368 | A | 11/1999 | Wood |
| 5,996,859 | A | 12/1999 | Beck |
| 6,039,224 | A | 3/2000 | Dallas et al. |
| 6,041,477 | A | 3/2000 | Rentsch et al. |
| 6,102,257 | A | 8/2000 | Goyet |
| 6,116,469 | A | 9/2000 | Wallays et al. |
| 6,152,320 | A | 11/2000 | Hierzer et al. |
| 6,158,632 | A | 12/2000 | Ekkert |
| 6,164,503 | A | 12/2000 | Forsyth et al. |
| D436,040 | S | 1/2001 | Warner et al. |
| 6,250,507 | B1 | 6/2001 | Ekkert |
| 6,250,517 | B1 | 6/2001 | Samz et al. |
| 6,283,317 | B1 | 9/2001 | Benoit-Gonin et al. |
| 6,289,906 | B1 | 9/2001 | Vanden et al. |
| 6,299,033 | B1 | 10/2001 | VerWeyst et al. |
| 6,308,870 | B2 | 10/2001 | Samz et al. |
| 6,321,923 | B1 | 11/2001 | Wood |
| 6,332,551 | B1 | 12/2001 | Copeland |
| D453,892 | S | 2/2002 | Lindsay et al. |
| RE37,634 | E | 4/2002 | Hickman et al. |
| 6,364,169 | B1 | 4/2002 | Knickerbocker |
| 6,382,476 | B1 | 5/2002 | Randall et al. |
| 6,405,885 | B1 | 6/2002 | Elliott |
| 6,439,410 | B1 | 8/2002 | Dubach |
| 6,460,712 | B2 | 10/2002 | Smith et al. |
| 6,460,718 | B1 | 10/2002 | Vogel |
| 6,460,726 | B1 | 10/2002 | Hierzer et al. |
| 6,464,113 | B1 | 10/2002 | Vogel |
| 6,488,187 | B2 | 12/2002 | Sheffler et al. |
| D468,639 | S | 1/2003 | Wennerstrom et al. |
| 6,510,971 | B1 | 1/2003 | Martin |
| D472,138 | S | 3/2003 | Brozell et al. |
| 6,550,626 | B1 | 4/2003 | Randall |
| 6,575,323 | B1 | 6/2003 | Martin et al. |
| D476,892 | S | 7/2003 | Martin et al. |
| D476,897 | S | 7/2003 | Brozell |
| 6,631,820 | B2 | 10/2003 | Harrold et al. |
| 6,644,487 | B2 | 11/2003 | Peterson et al. |
| 6,688,501 | B2 | 2/2004 | DeGroot et al. |
| 6,691,901 | B2 | 2/2004 | Parve et al. |
| 6,757,957 | B2 | 7/2004 | McClean et al. |
| 6,761,279 | B1 | 7/2004 | Martin et al. |
| 6,766,926 | B1 | 7/2004 | Elchert |
| 6,786,363 | B1 | 9/2004 | Lohrman |
| 6,830,721 | B2 | 12/2004 | Martin |
| 6,880,736 | B1 | 4/2005 | Gnepper |
| 6,935,543 | B2 | 8/2005 | DeGroot et al. |
| D509,426 | S | 9/2005 | Samz et al. |
| 6,948,643 | B1 | 9/2005 | Lohrman |
| D513,983 | S | 1/2006 | Erdie |
| D518,377 | S | 4/2006 | Kortleven |
| 7,134,575 | B2 | 11/2006 | Vogel et al. |
| D562,132 | S | 2/2008 | LaMasney |
| 7,721,911 | B2 | 5/2010 | Chou |
| 7,909,212 | B2 | 3/2011 | Parve |
| 2002/0079339 | A1 | 6/2002 | Sheffler et al. |
| 2003/0080130 | A1 | 5/2003 | Goetz et al. |
| 2003/0116879 | A1 | 6/2003 | Mueller et al. |
| 2004/0134942 | A1 | 7/2004 | Parve et al. |
| 2004/0169307 | A1 | 9/2004 | Mueller et al. |
| 2004/0226950 | A1 | 11/2004 | Samz et al. |
| 2005/0023304 | A1 | 2/2005 | Vogel et al. |
| 2006/0278665 | A1 | 12/2006 | Bennett |
| 2008/0093394 | A1 | 4/2008 | Peterson et al. |
| 2012/0085791 | A1 | 4/2012 | Groubert et al. |

FOREIGN PATENT DOCUMENTS

| | | |
|---|---|---|
| DE | 37 34 156 | 4/1988 |
| DE | 42 39 299 | 3/1994 |
| EP | 0 590 325 | 4/1994 |
| EP | 0 631 942 | 1/1995 |
| WO | WO-94/20713 | 9/1994 |

CLOSURE FOR A CONTAINER

CROSS REFERENCE TO RELATED PATENT APPLICATIONS

The present application is a continuation-in-part of U.S. patent application Ser. No. 13/429,747, having a filing date of Mar. 26, 2012, and titled "Closure for a Container," the complete disclosure of which is hereby incorporated by reference.

FIELD

The present disclosure relates generally to a closure for a container for storing and dispensing materials (e.g., a particulate matter, etc.). The present disclosure more specifically relates to a closure having a rotatable cover portion for enclosing and/or revealing one or more dispensing openings in the closure.

BACKGROUND

This section is intended to provide a background or context to the subject matter recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

It is generally known to provide a cover or closure on a container used for storing and dispensing particulate matter (e.g., granulated, powdered, etc.) or other materials, particularly foodstuffs, seasonings, etc. such as those displayed and sold in supermarkets. Such a closure typically attaches to an open end of a receptacle and has at least one dispensing opening for dispensing the material retained with the receptacle. Such closures typically allow for a user to selectively to enclose and/or reveal the at least one dispensing opening, for example, by actuating a hinged flap associated with the at least one dispensing opening or by rotating a cover portion relative to the at least one dispensing opening. If a rotatable cover portion is provided on such a closure, the cover portion is typically allowed to rotate freely relative to the at least one dispensing aperture.

SUMMARY

One embodiment of the disclosure relates to a closure configured to fit over a mouth of a receptacle to form a container. The closure includes a body having an open bottom formed of a skirt that defines an outer periphery of the body and an end wall defining at least one body dispensing aperture. A cover has two or more cover dispensing apertures and is rotatably coupled to the body and movable between a dispensing position with at least one of the cover dispensing apertures aligned with the body dispensing aperture, and a closed position. A handle has segments extending between each of the cover dispensing apertures, and one or more cover position stops provide a tactile or an audible indication when the cover is moved to either of the dispensing position or the closed position.

Another embodiment of the disclosure relates to a closure configured to fit over a mouth of a receptacle to form a container. The closure includes a body having an open bottom formed of a skirt that defines an outer periphery of the body and an end wall defining one or more body dispensing apertures, and defining one or more raised body portions. A cover is coupled to the end wall of the body and has one or more raised cover dispensing apertures and is rotatably movable relative to the body between a dispensing position with at least one of the cover dispensing apertures aligned with at least one of the body dispensing apertures, and a closed position with the raised body portions aligned with the cover dispensing apertures.

Another embodiment of the disclosure relates to a closure configured to fit over a mouth of a receptacle to form a container. The closure includes a body having an open bottom formed of a skirt that defines an outer periphery of the body portion and an end wall defining one or more raised body portions and at least one body dispensing aperture defined within one or more of the raised body portions. A cover has one or more raised cover portions and at least one cover dispensing aperture within one of the raised cover portions. The cover is rotatably coupled to the body and movable between a dispensing position with the cover dispensing apertures aligned with the body dispensing apertures, and a closed position with the raised body portions aligned with the cover dispensing apertures.

Another embodiment of the disclosure relates to a closure configured to fit over a mouth of a receptacle to form a container. The closure includes a body having an open bottom formed of a skirt that defines an outer periphery of the body and an end wall having raised body portions and at least one body dispensing aperture within the raised body portions so that a lip is defined around the body dispensing aperture. A cover has one or more raised cover portions and at least one cover dispensing aperture within the raised cover portions. The cover is rotatably coupled to the body and movable between a dispensing position with the cover dispensing apertures aligned with the body dispensing apertures, and a closed position with the raised body portions aligned with the cover dispensing apertures. The raised body portions are configured to nest at least partially within the raised cover portions in both the dispensing position and the closed position.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
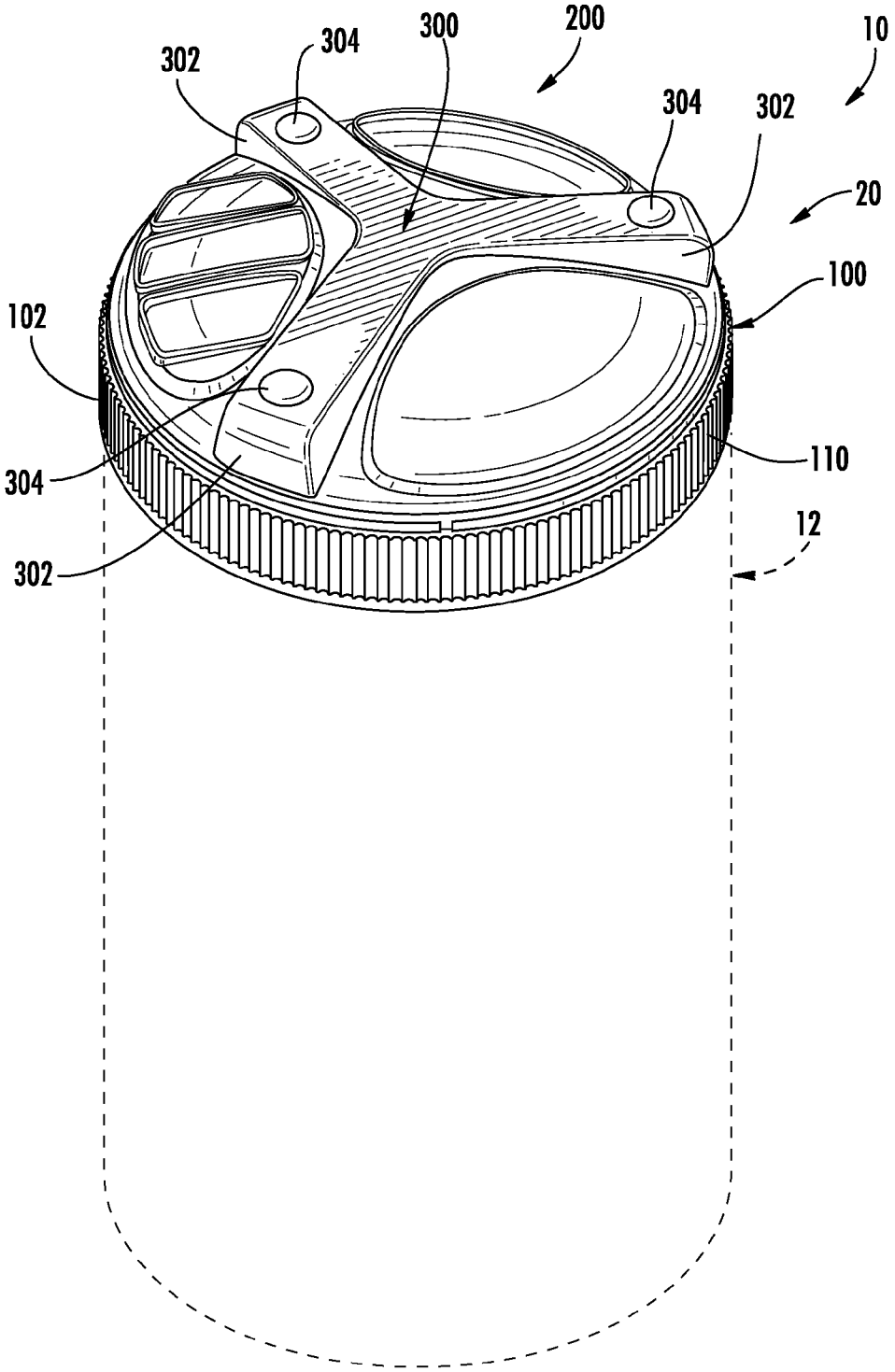
FIG. 1 is a perspective view of a container according to an exemplary embodiment.
Figure 14:
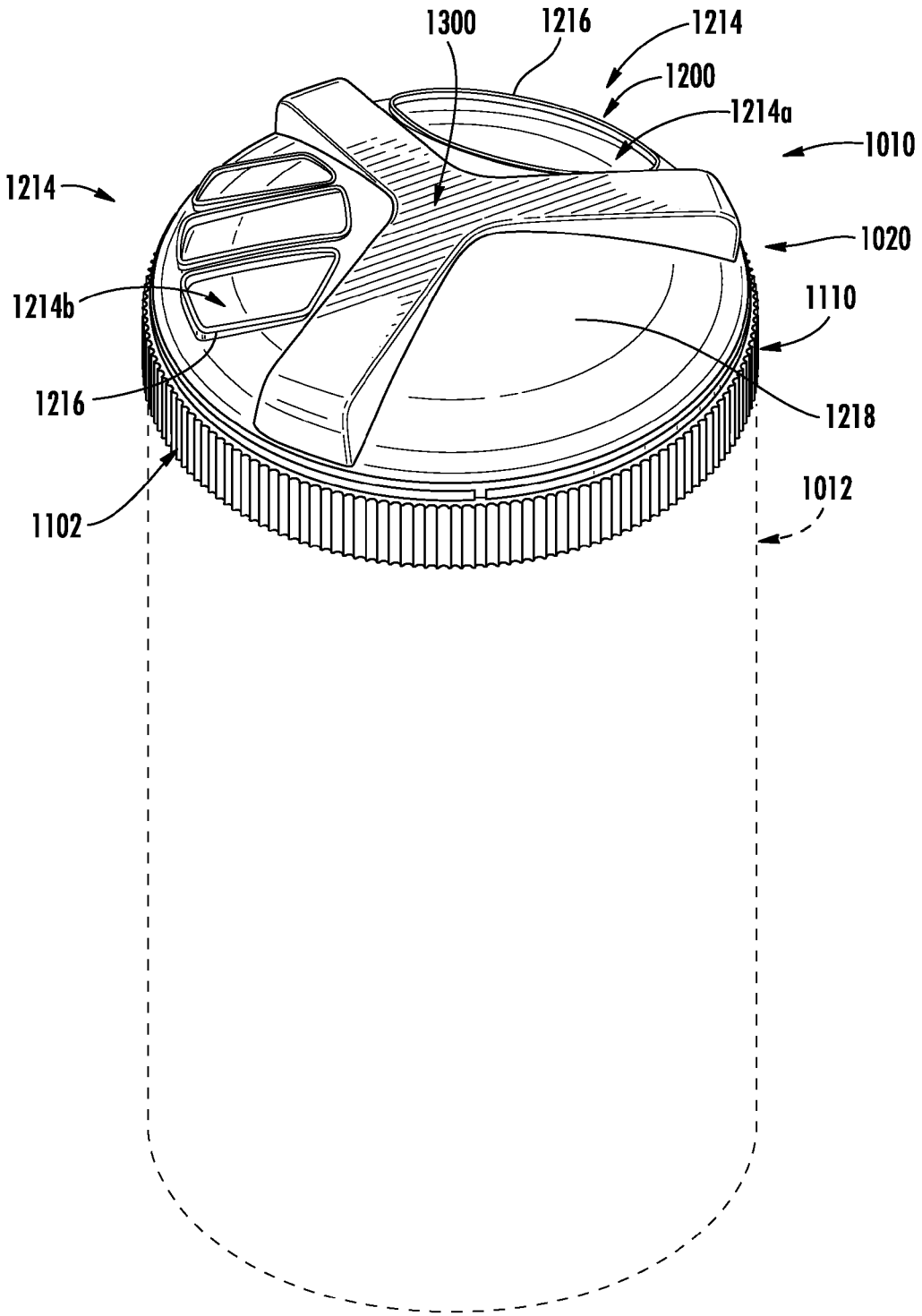
FIG. 14 is a perspective view of a container according to another exemplary embodiment.
Figure 15:
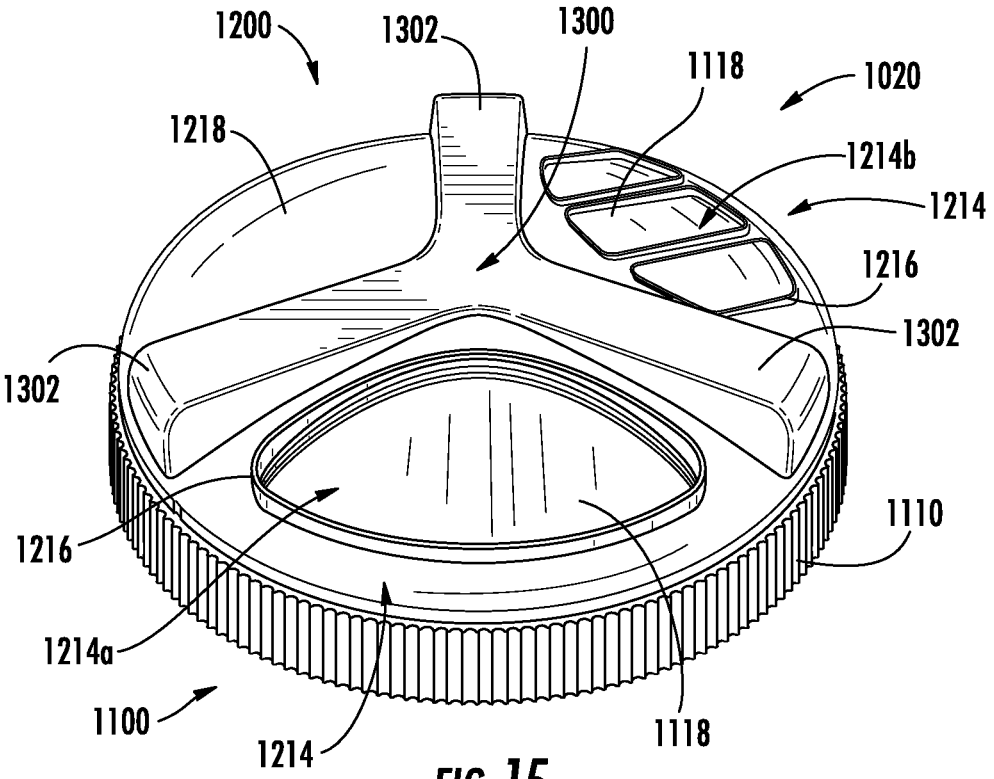
FIG. 15 is a perspective view of a closure from the container of FIG. 14 according to another exemplary embodiment.
Figure 18:
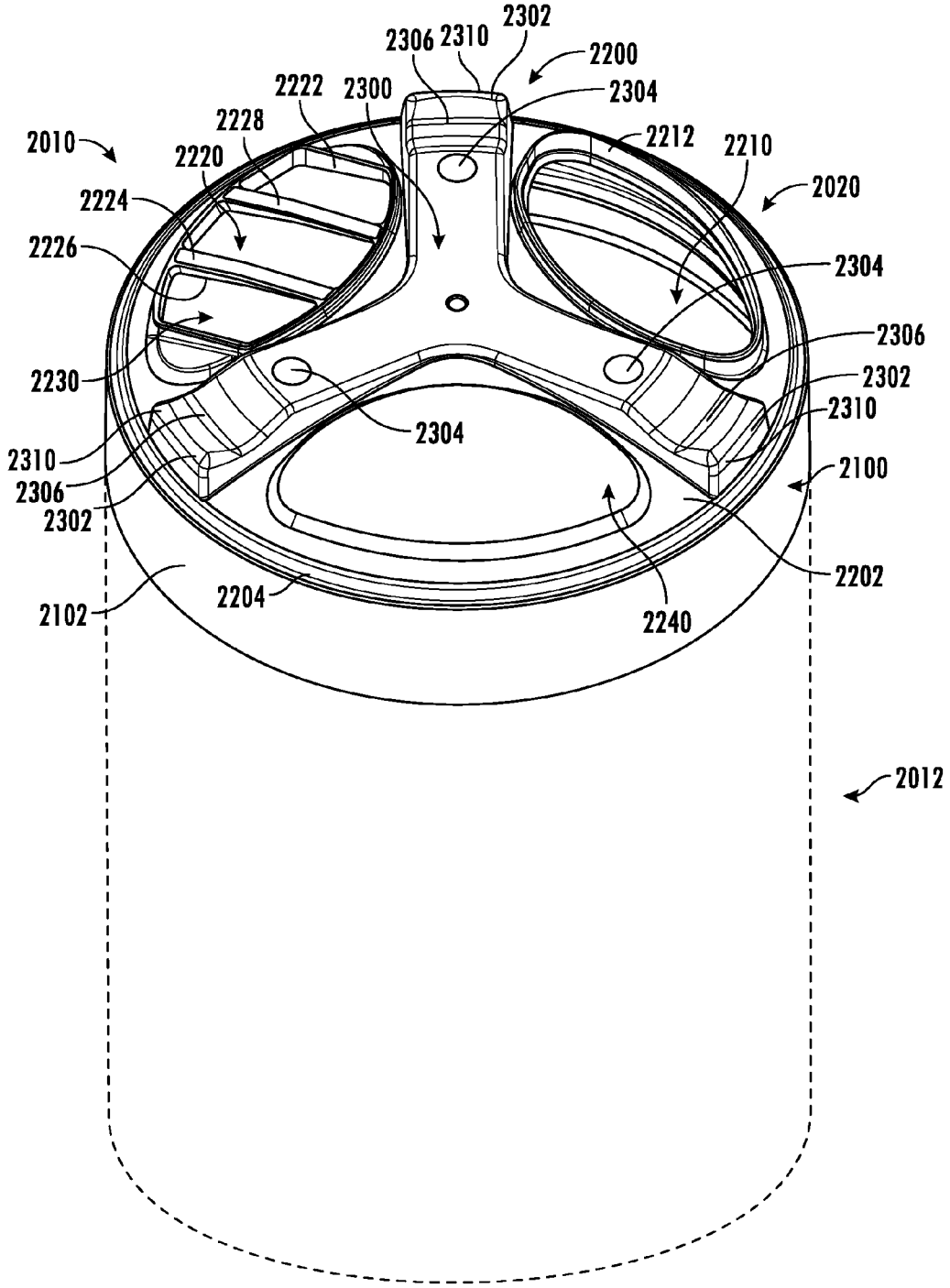
FIG. 18 is a perspective view of a container according to another exemplary embodiment.
Figure 19:
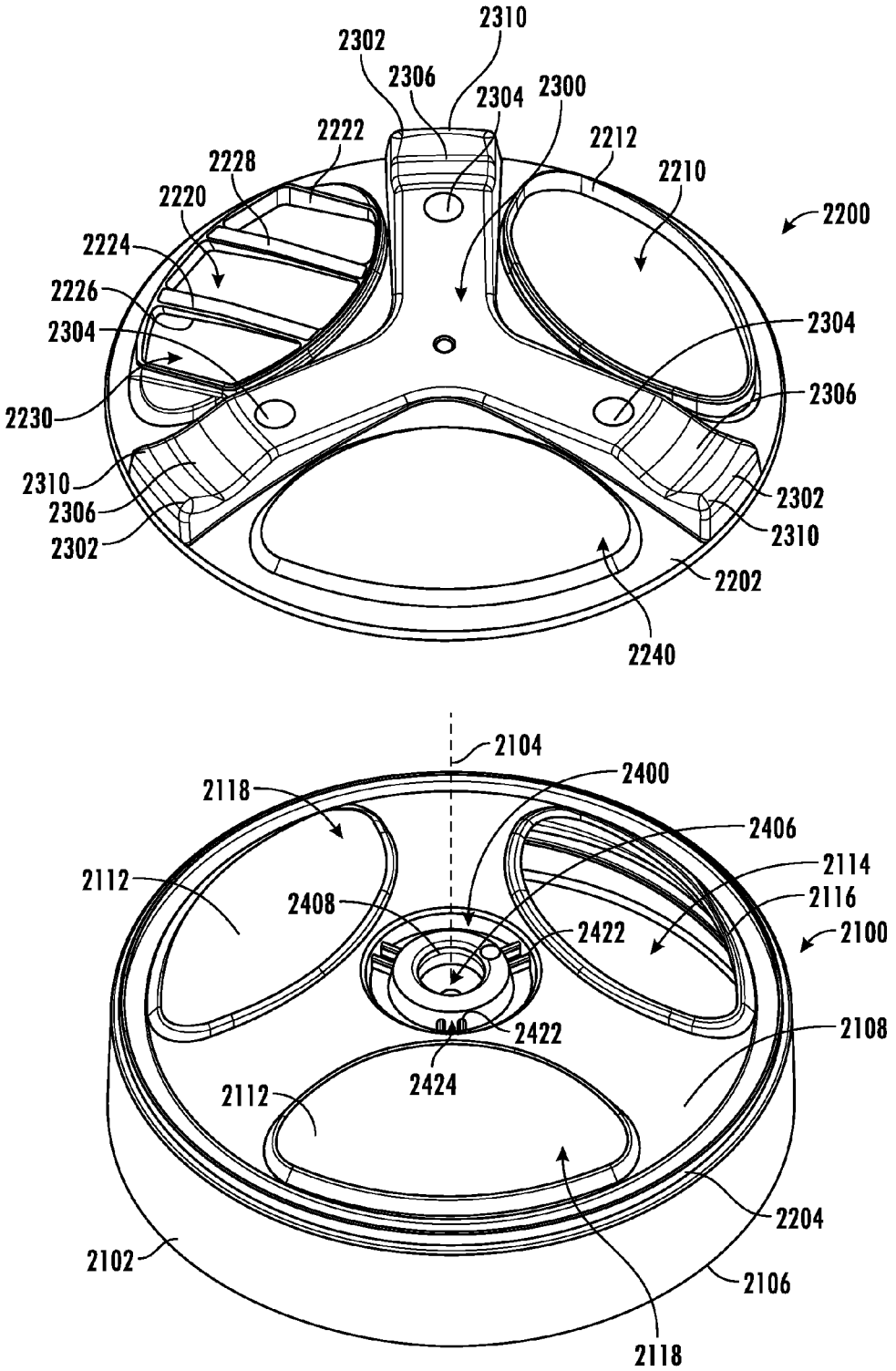
FIG. 19 is an exploded perspective view of the closure of FIG. 19.
Figure 20:
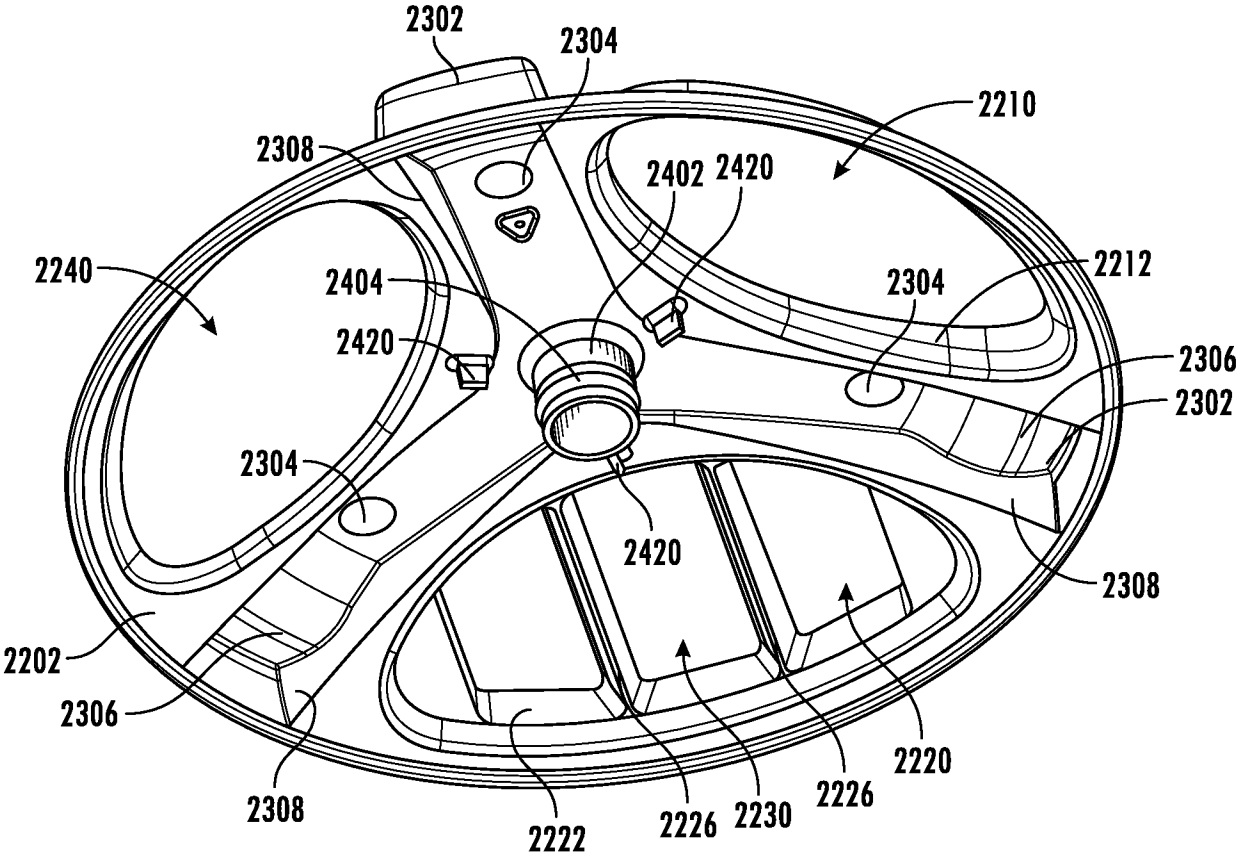
FIG. 20 is a bottom perspective view of a cover portion of the closure of FIG. 19.

Referring to the FIGURES in general, a closure and components thereof are shown according to various exemplary embodiments. FIGS. 1-13 show a first exemplary embodiment of the closure, FIGS. 14-17 show a second exemplary embodiment, and FIGS. 18-20 show a third exemplary embodiment. In FIGS. 1, 14, and 18, the closures are shown as being coupled to a receptacle to form a container. The closures allow for the selectively dispensing of matter stored within a receptacle. Such matter may include particulate matter such as rock salt for melting ice, fertilizer, foodstuffs such as cheese, spices, powdered creamers, etc., or a variety of other matter (e.g., including liquid matter, solid matter, semi-solid matter, etc.) that is capable of being stored within a receptacle and that can be dispensed through a dispensing opening that may be provided in the closure.

While the closures are shown in FIGS. 1, 14, and 18 as being used in combination with a cylindrical receptacle having a cross section that is circular in shape, the closures may be suitable for use with any of a variety of receptacles, having any of a variety of shapes and sizes. The receptacles shown in FIGS. 1, 14, and 18 are provided for illustrative purposes only, and are not intended to infer any limitations on the scope of use of the closures.

Figure 2:
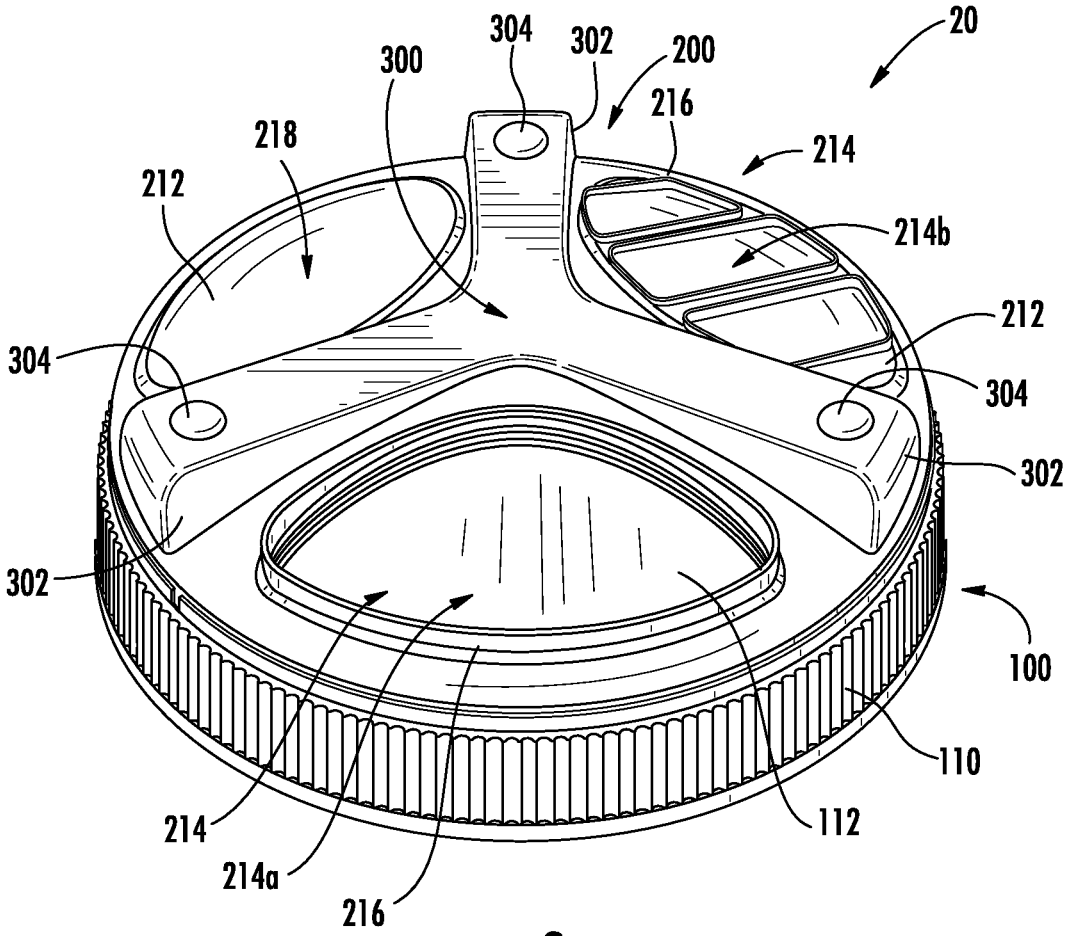
FIG. 2 is a perspective view of a closure from the container of FIG. 1 according to an exemplary embodiment.
Figure 3:
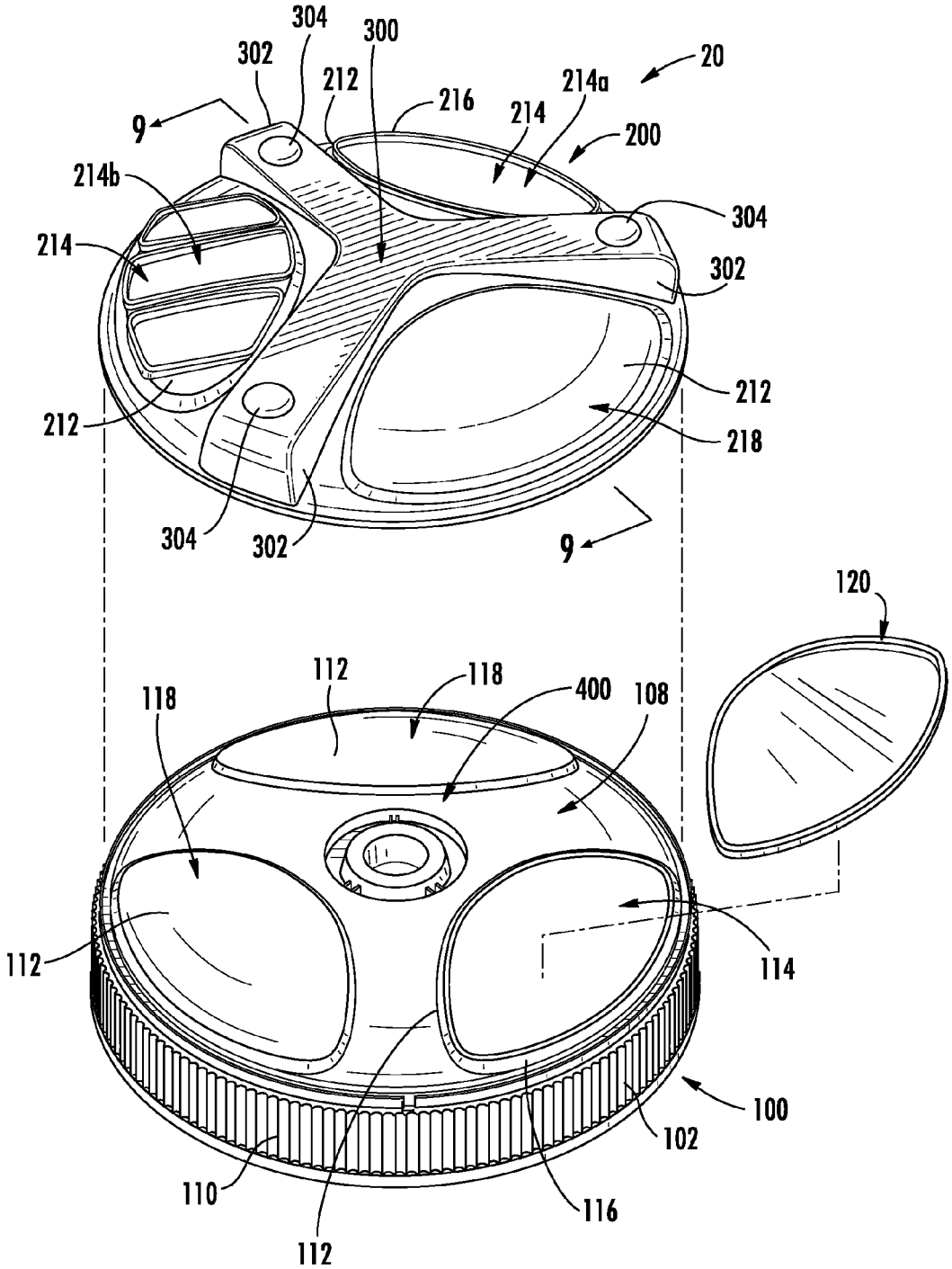
FIG. 3 is an exploded perspective view of the closure of FIG. 2.
Figure 4:
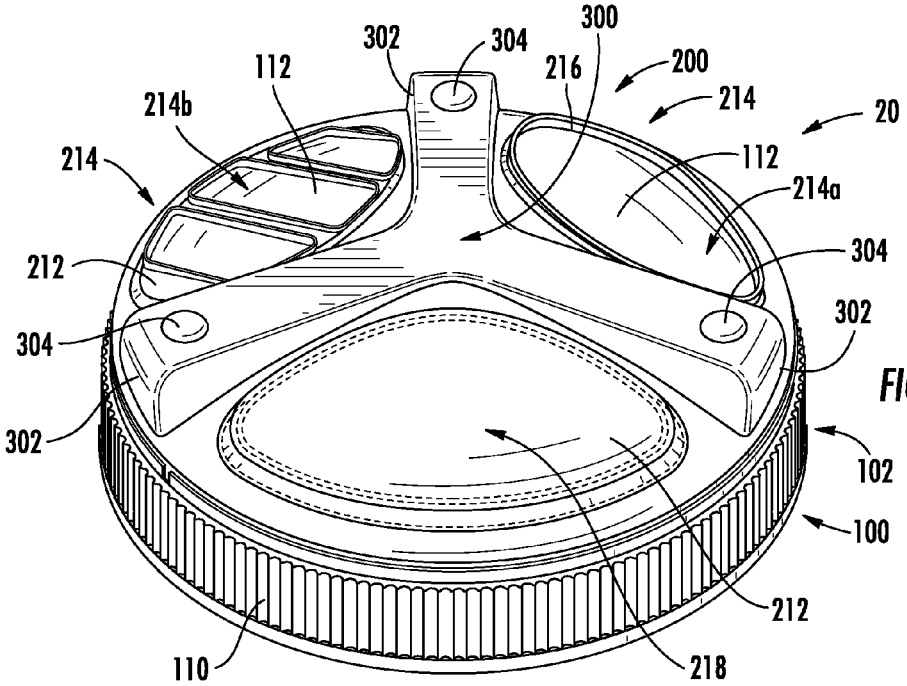
FIG. 4 is a perspective view of the closure of FIG. 2 shown in a closed position.

Referring to FIGS. 1-13, the closure is shown according to a first exemplary embodiment as a closure 20. Referring to FIGS. 1-3 in particular, closure 20 is shown as a generally including a body portion (e.g., base, bottom, etc.), shown as body 100 and a cover portion (e.g., lid, dial, top, etc.), shown as a cover 200. Closure 20 is configured to fit over a mouth of a receptacle 12 to form a container 10. Body 100 has an open bottom formed of a skirt 102 that defines an outer periphery of the body 100 and an end wall 108.

Figure 9:
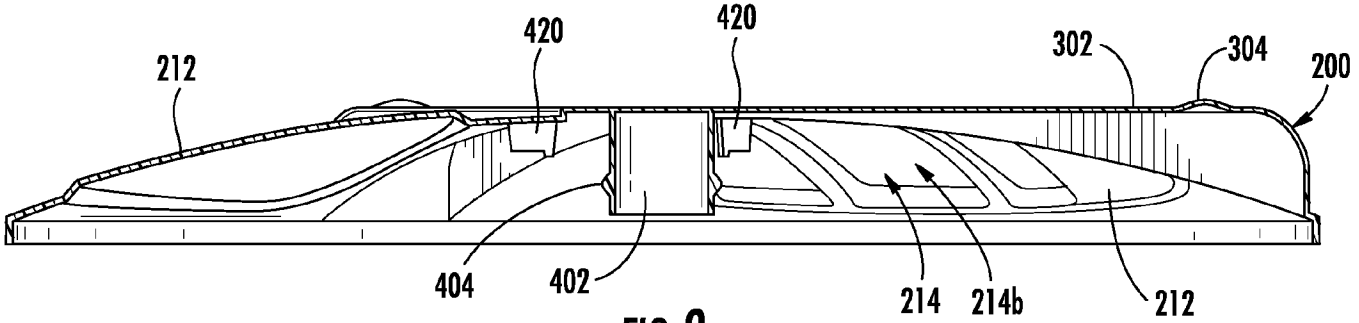
FIG. 9 is a cross sectional view of the cover portion of FIG. 7.
Figure 9A:
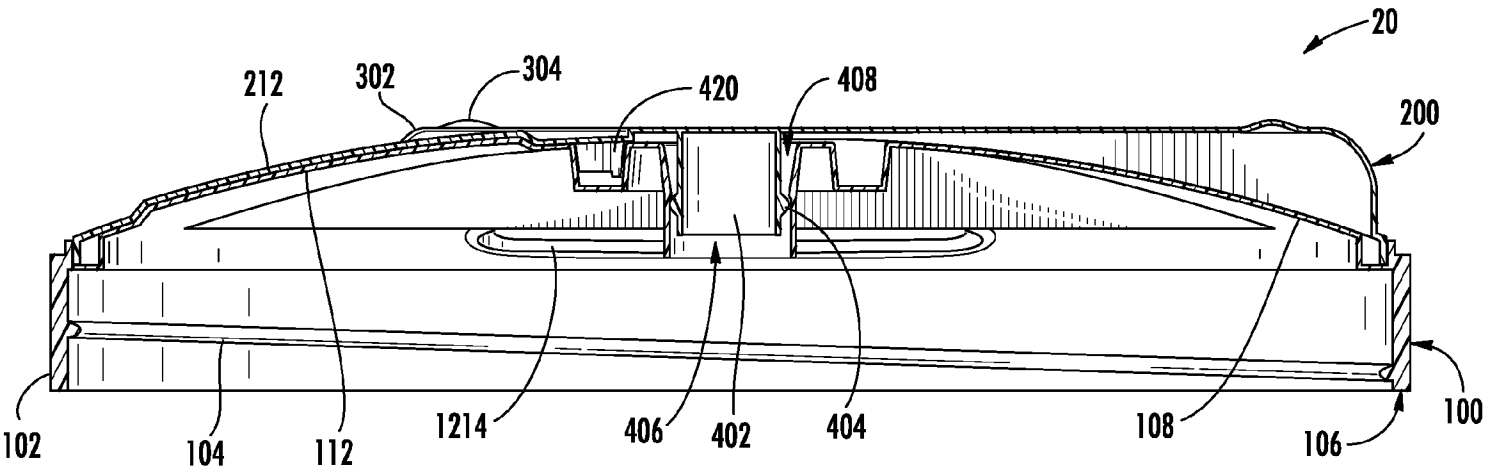
FIG. 9A is a cross sectional view of the closure of FIG. 2.
Figure 10:
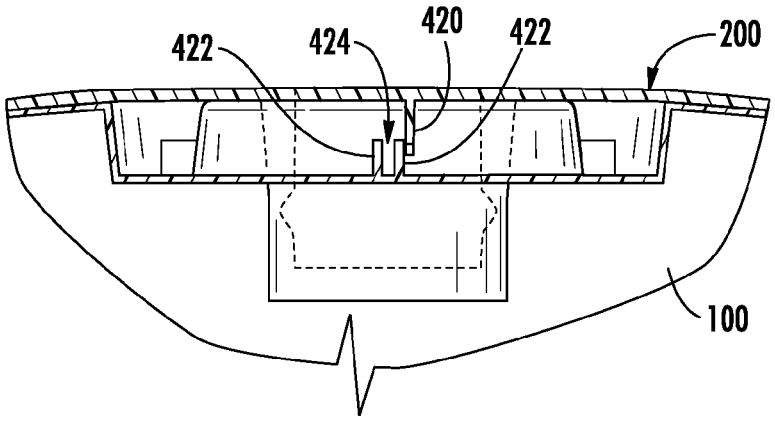
FIG. 10 is a partial cross sectional view of the closure showing the cover portion in a first position relative to the base portion.
Figure 11:
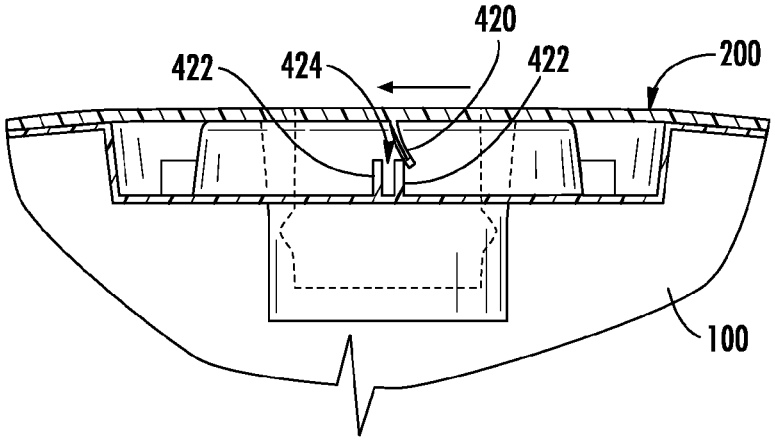
FIG. 11 is a partial cross sectional view of the closure showing the cover portion in a second position relative to the base portion.
Figure 12:
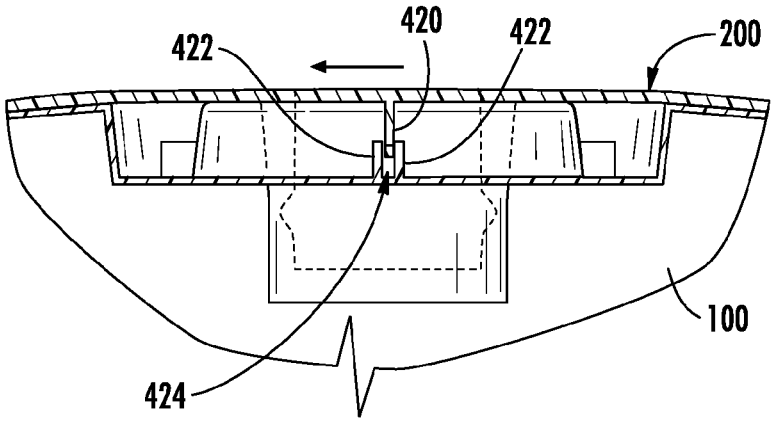
FIG. 12 is a partial cross sectional view of the closure showing the cover portion in a third position relative to the base portion.
Figure 13:
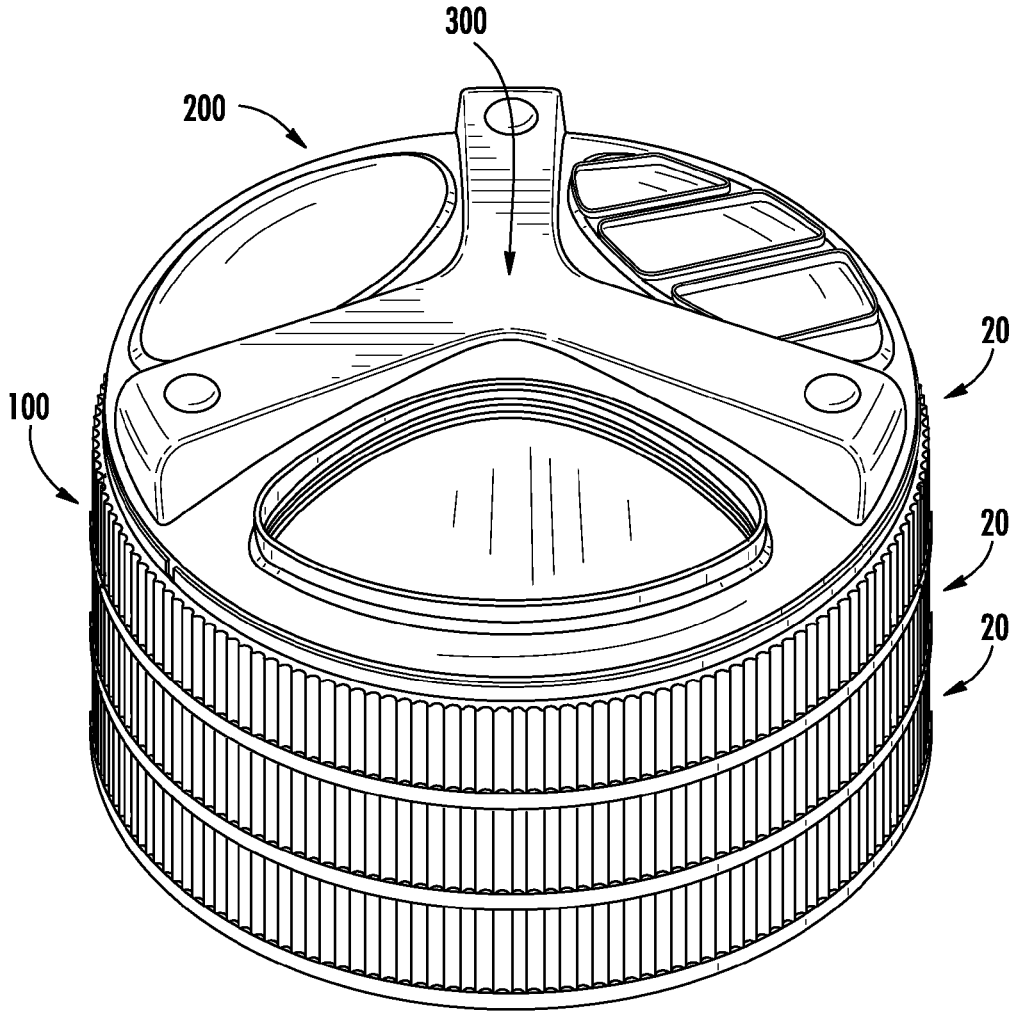
FIG. 13 is a perspective view of a plurality of closures stacked together to form a log suitable for storage and/or transport of the closures.

Referring to FIGS. 3 and 9A, body portion 100 has a side wall 102 (e.g., skirt, etc.) adapted to fit over an end of receptacle 12. According to one exemplary embodiment, side wall 102 is cylindrical in shape and has a coupling component (e.g., attachment structure), shown as threads 104, located on an inside surface for engaging a corresponding coupling component (e.g., threads, etc.) on receptacle 12 to secure closure 20 to the open end of receptacle 12. According to the various alternative embodiments, the coupling component may be any known or otherwise suitable structure (e.g., press-on rings or snap-fit structure, ribs, etc.) for coupling closure 20 to receptacle 12.

Side wall 102 is shown as extending continuously in a substantially vertical direction between a bottom edge 106 (e.g., a free end, etc.) of side wall 102 and an end wall 108 of body portion 100. Side wall 102 may be slightly tapered such that the diameter of side wall 102 near the top of body portion 100 is slightly smaller than the diameter of side wall 102 near the bottom of body portion 100. Such a slight taper (which may be as small as several thousandths of an inch) is intended to reduce the potential for interference with machinery that may be used to couple closure 20 to receptacle 12.

Side wall 102 is also shown as including a gripping surface 110 (e.g., a textured area, serrated area, ribs, etc.) that is intended to facilitate gripping by a user for rotating or otherwise moving body portion 100 and/or closure 20 relative to receptacle 12. According to the embodiment illustrated, gripping surface 110 includes a plurality of vertical indentations (e.g. knurling or the like) that are adjacently spaced substantially around the entire periphery of side wall 102. According to an exemplary embodiment, the vertical indentations may be integrally molded into side wall 102.

According to an exemplary embodiment, the thickness of side wall 102 remains substantially constant from the top end (e.g., the end of side wall 102 closest to end wall 108) to the bottom end 106 (e.g., the end of side wall 102 opposite the top end) of side wall 102. According to the various alternative embodiments, the thickness of the side wall 102 may reduce as side wall 102 extends from the top end to the bottom end such that the thickness of side wall 102 near its bottom end is less than the thickness of side wall 102 near its top end. The reduction in the thickness of side wall 102 as it extends away from end wall 108 may reduce the extent to which body portion 100 takes a noncircular or oval shape when it is removed from the mold. According to other alternative embodiments, the thickness of side wall 102 may increase as it extends away from end wall 108 or may otherwise vary along the height of side wall 102.

Body portion 100 also includes end wall 108 which is shown as being slightly dome-shaped and oriented substantially perpendicular to a central axis of side wall 102. According to an exemplary embodiment, end wall 108 and side wall 102 are integrally formed as a single unitary body in a single mold by an injection molding operation to form body portion 100. According to the various alternative embodiments, end wall 108 and side wall 102 may be formed separately and may be coupled together in any known or otherwise suitable manner (e.g., snap-fit, adhesive, welding, etc.).

Referring further to FIG. 3, end wall 108 includes one or more raised body portions 112 (e.g. bulge, protuberance, boss, platform, etc.), shown by way of example as three raised body portions 112 spaced radially and circumferentially about the end wall. According to an exemplary embodiment, end wall 108 also includes at least one body dispensing aperture 114 (e.g. opening, mouth, etc.), disposed on a raised body portion 112 so that the remaining surface of the raised body portion 112 surrounding the body dispensing aperture 114 defines a lip 116. Lip 116 is intended to channel or divert any fluids or liquids (e.g. condensation, rainwater, etc.) on end wall 108 around and away from body dispensing aperture 114. According to the illustrated embodiment of FIG. 3, one body dispensing aperture 114 is provided on one of the raised body portions 112, and the remaining raised body portions 112 provide a closed barrier 118.

Referring further to FIGS. 1-3, cover 200 is also slightly dome-shaped to correspond with the dome-shaped end wall 108 and further includes one or more raised cover portions 212 (e.g. in the manner of a bulge, protuberance, boss, platform, etc.), shown by way of example as three raised cover portions 212 spaced radially and circumferentially about the cover 200, and corresponding generally to the shape, size, spacing and position of the raised body portions 112 such that the raised body portions 112 and the raised cover portions 212 may be selectively rotated into registry and nestable with one another when the body 100 and cover 200 are assembled to form the closure 20. According to an exemplary embodiment, cover 200 also includes at least one cover dispensing aperture 214 (e.g. opening, mouth, etc.), disposed on a raised cover portion 212 so that the remaining surface of the raised cover portion 212 surrounding the cover dispensing aperture 214 defines a lip 216. Lip 216 is intended to channel or divert any fluids or liquids (e.g. condensation, rainwater, etc.) on cover 200 around and away from cover dispensing aperture 214. According to the illustrated embodiment of FIG. 3, two cover dispensing apertures 214 are provided, one each on a raised cover portion 212, and the remaining raised cover portion 212 provides a closed barrier 218. According to an exemplary embodiment, a seal 120 (see FIG. 3) may be provided on lip 116 across body dispensing aperture 114 to seal the contents of the container 10 until ready for removal and use by a consumer. According to any exemplary embodiment, the end wall 108 and cover 200 may include any number of dispensing openings, and each dispensing opening may have a shape and size that is suitable to the application in which the closure will be used. For example, the dispensing openings may be circular, rectangular, football-shaped, half moon-shaped, segregated into multiple sub-apertures, or a variety of other shapes and sizes. By further way of example, the dispensing apertures may be configured for relative alignment to provide a "pour" opening, a "shake" opening, or a combined "pour and shake" opening for the container.

Figure 5:
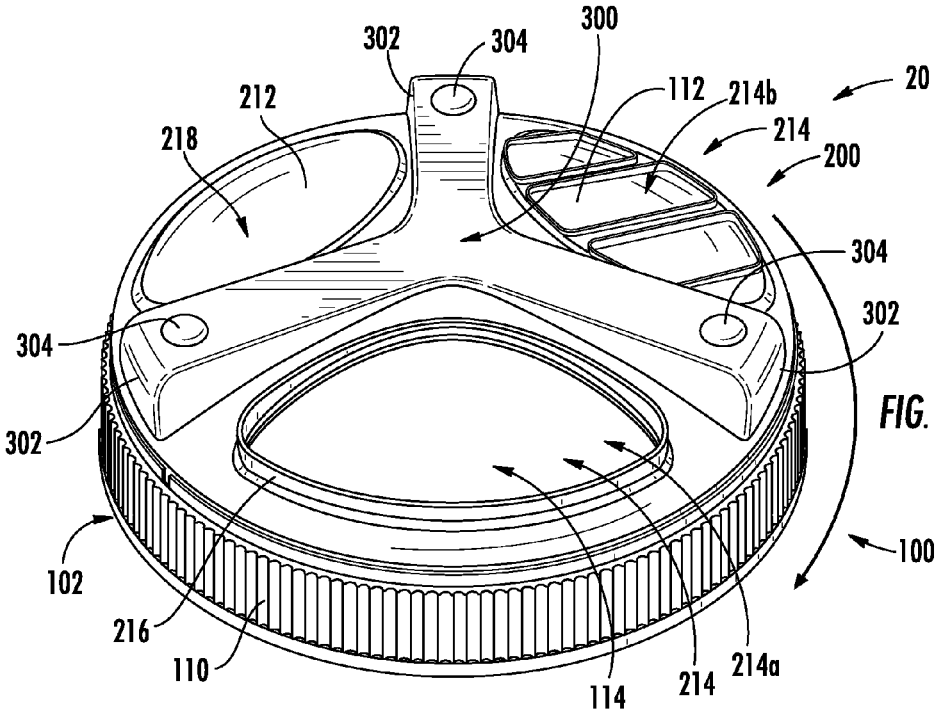
FIG. 5 is a perspective view of the closure of FIG. 2 shown in a first open position.
Figure 6:
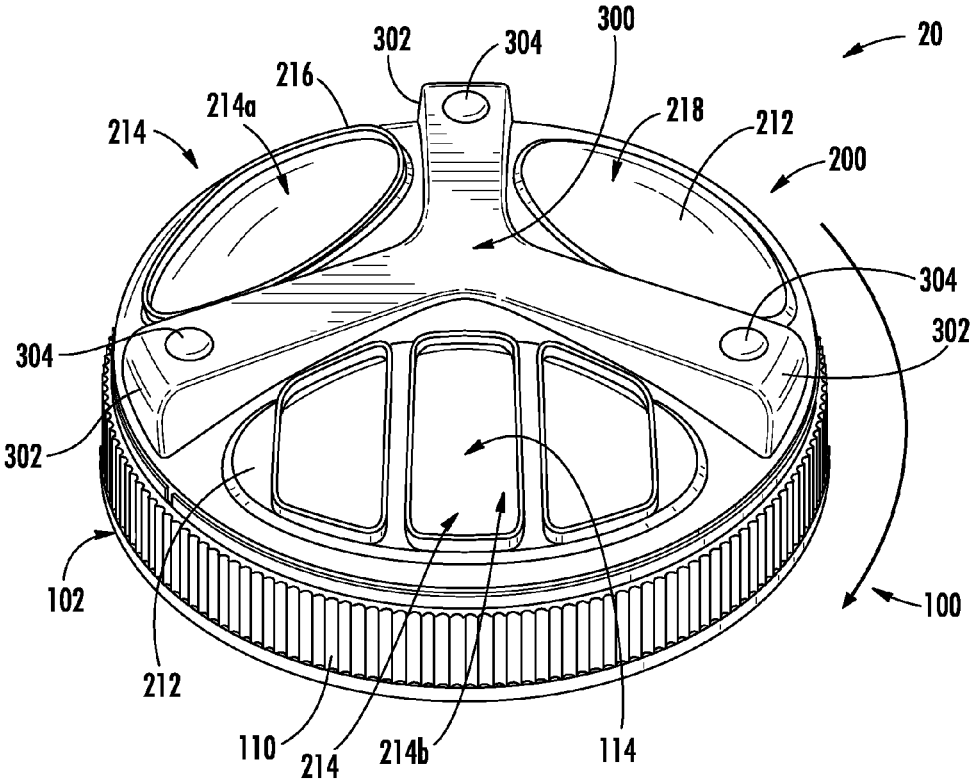
FIG. 6 is a perspective view of the closure of FIG. 2 shown in a second open position.

Cover 200 is intended to be coupled to body 100 at a pivot mechanism 400 (see FIGS. 3, 7 and 8) to form the closure 20, with the central regions of the body 100 and cover 200 axially interlocked, but with the cover 200 configured for rotational movement relative to body 100 between a closed position (shown in FIG. 4 with the raised cover portion 212 having the closed barrier 218 being substantially aligned with the body dispensing aperture 114 to prevent dispensing the contents) and one or more open dispensing positions (shown in FIGS. 5 and 6). Referring to FIG. 5, the cover may be rotated to a first dispensing position with a first cover dispensing aperture 214*a* (shown as a generally open mouth corresponding to a "pour" position) being substantially aligned with the body dispensing aperture 114 (shown as a corresponding generally open mouth). Referring to FIG. 6, the cover 200 may be further rotated to a second dispensing position with a second cover dispensing aperture 214*b* (shown as a having multiple sub-apertures separated by dividers (e.g. ribs, etc.) corresponding to a shake or a "shake-pour" position) being substantially aligned with the body dispensing aperture 114.

Figure 7:
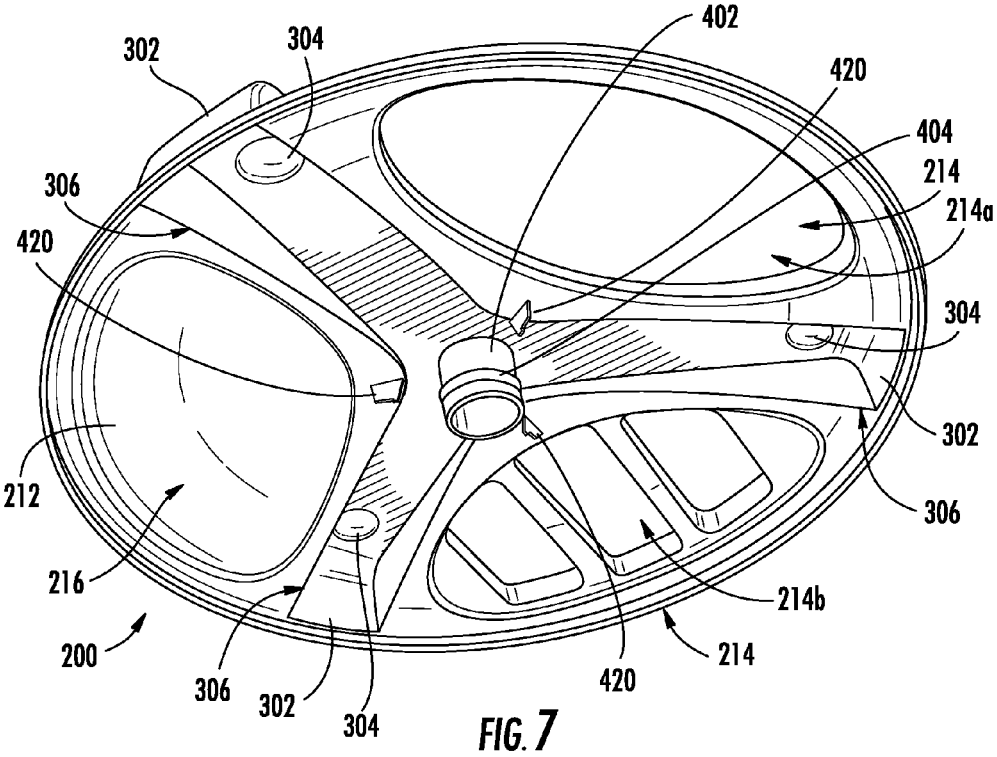
FIG. 7 is a bottom perspective view of a cover portion of the closure of FIG. 2 shown according to an exemplary embodiment.
Figure 8:
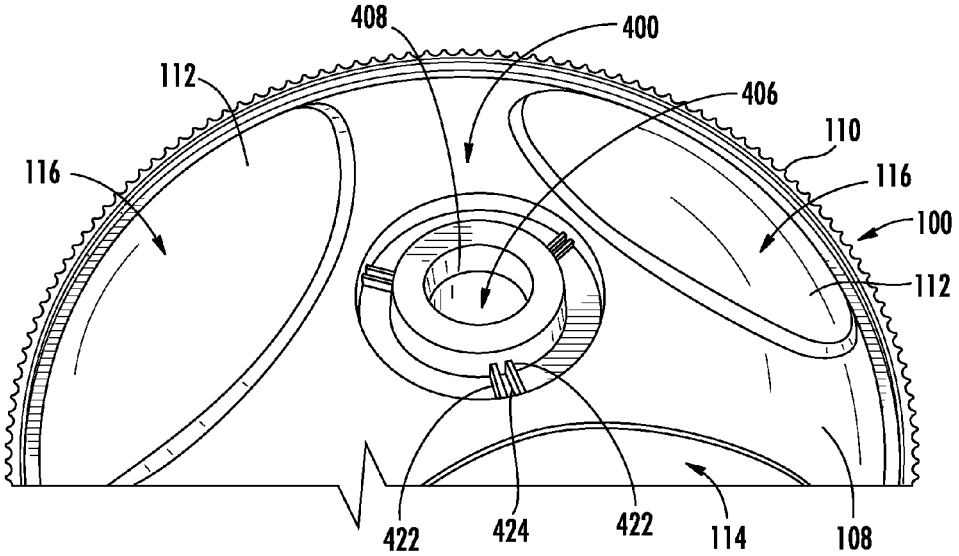
FIG. 8 is a partial top perspective view of an end wall of the body portion of the closure of FIG. 2 shown according to an exemplary embodiment.

Referring further to FIGS. 1-6, the ability to impart a rotational movement of cover 200 relative to body 100 is facilitated by a user interface, shown as a handle 300, that is provided on cover 200. According to an exemplary embodiment, handle 300 comprises one or more segments 302 (e.g. projections, lobes, etc.) extending radially from a shared central axis of cover 200 and the body 100. Each of segments 302 is further shown to include one or spacers (e.g. projections, bosses, etc.) and shown as bumps 304 to facilitate stacking of containers 10 one atop another. The amount of matter dispensed from the closure 20 can be adjusted by rotating the cover 200 to align with the desired cover dispensing apertures with the body dispenser aperture. According to an exemplary embodiment, cover 200 and body 100 are formed in a convex or dome shape in a closely nesting relationship (shown in FIG. 9A), so that the raised body portions 112 are configured to nest at least partially within the raised cover portions 212 when the cover 200 is in both the dispensing position and the closed position. Referring to FIG. 7, an underside of cover 200 includes edges 306 formed by the segments 302 of the handle 300, such that the edges 306 are configured to engage the top of the cover 200 to collect or "sweep" residual matter that may remain on the cover 200 following the dispensing of matter from the container 10. As cover 200 is rotated, matter is "collected" by edges 306 and urged toward the body dispensing aperture where the matter may be returned to the container.

Referring to FIGS. 3 and 7-9A, an interface for rotationally coupling the cover 200 to the body 100 (shown as a pivot mechanism 400) is shown according to an exemplary embodiment. Cover 200 includes a downwardly extending projection 402 (e.g. post, axle, pivot, etc.) having a circumferential ridge 404 (e.g. rib, barb, etc.) configured to be received within a bore 406 (e.g. cylindrical opening, hole, etc.) formed in end wall 108 for rotational movement of cover 200 relative to body 100 in a close-fitting relationship (shown schematically in FIG. 9A), where raised body portion 112 is shown to nest within raised cover portion 212, with the end wall 108 and the cover 200 resiliently flexing with respect to one another as the cover is rotated relative to the body 100 about the pivot mechanism 400. Projection 402 is shown schematically as a circular post and includes a keeper (e.g. annular projection, barb, rib, etc.) shown schematically as a circumferential ridge 404, or other suitable structure to permit the central region of the cover 200 to be axially interlocked with the central region of the end wall 108 in a manner that permits rotational movement. Bore 406 also includes a mating keeper (e.g. annular projection, barb, rib, etc.) shown schematically as a circumferential ridge 408, which is configured to engage ridge 404 in an axial interference manner to provide a rotatable snap-fit connection.

Referring further to FIGS. 7 and 10-12, inter-engaging structure are provided on the body 100 and cover 200 to provide cover indexing or positioning stops as the cover 200 is rotated to/from the dispensing positions and the closed position, according to an exemplary embodiment. An underside of cover 200 includes projections, shown as tabs 420 that are arranged to correspond with each of the raised cover portions 212 at which a position stop is desired. A top side of the end wall 108 includes correspondingly positioned receptacles (e.g. recesses, pockets, etc. shown as three receptacles), shown by way of example as a gap 424 between two parallel projections 422 on end wall 108. When the cover 200 is rotatably coupled to the body 100 at the pivot connection 400 and rotated toward either a dispensing position or a closed position (e.g. where the raised body portions 112 and the raised cover portions 212 are approaching alignment), the tabs 420 approach the parallel projections 422 in an interference manner (see FIG. 10). As additional rotational force is applied to the cover 200, the tab 420 (and/or the cover 200) resiliently flex a sufficient amount for the tab 420 to ride over the projection 422 (see FIG. 11) and then be captured within the gap 424 between the projections 422, which corresponds to a position of axial alignment of the raised cover portions 212 and the raised body portions 112, so that the cover "stops" at the desired position, until a sufficient rotational force is applied to the cover 200 to move the tab 420 out of the gap 424 and to a new position. According to one embodiment, the operation of the position stops provides both a tactile (e.g. detent, etc.) indication and an audible indication (e.g. click, etc.) to provide additional feedback to a user that the cover 200 and body 100 have been aligned in a desired position. According to an alternative embodiment, the orientation of the projections 422 and tabs 420 may be reversed so that the projections extend from an underside of the cover 200 and the tabs 420 extend from the end wall 108. According to another embodiment, the resiliency of the end wall 108 and cover 200 (as axially constrained by the pivot mechanism 400) also provide a position stop, such that when the raised body portions 112 and the raised cover portions 212 are aligned and nested, additional force is required to rotate the cover 200 such that sufficient flexure occurs to permit the cover 200 to cam-over the raised body portion 112 to separate the nested raised portions, until the raised body and cover portions are realigned and re-nested.

According to an exemplary embodiment, body 100 and cover 200 may be formed from a plastic materials in separate molds (e.g. in an injection molding procedure or the like) and then joined to form closure 20 by a suitable assembly procedure in which axial post 402 is received within bore 406 and circumferential ridges 404, 408 engage one another in an axially interlocking manner (e.g. interference type, snap-fit connection). After the body 100 and cover 200 are assembled to form closure 20, the closures are configured to be axially stacked in a relatively high-density configuration (see FIG. 13) to facilitate maintaining the roundness and shape of the closures during post-mold cooling, and to facilitate handling and shipping to a facility where the containers are filled and then enclosed by the closures.

Referring now to FIGS. 14-17, the closure is shown according to a second exemplary embodiment as a closure 1020. Closure 1020 is similar in many respects to closure 20, however closure 1020 is formed and operates without raised body portions and raised cover portions. More particularly, closure 1020 is shown as a generally including a body portion (e.g., base, bottom, etc.), shown as body 1100 and a cover portion (e.g., lid, dial, top, etc.), shown as a cover 1200. Closure 1020 is configured to fit over a mouth of a receptacle 1012 to form a container 1010.

Figure 17:
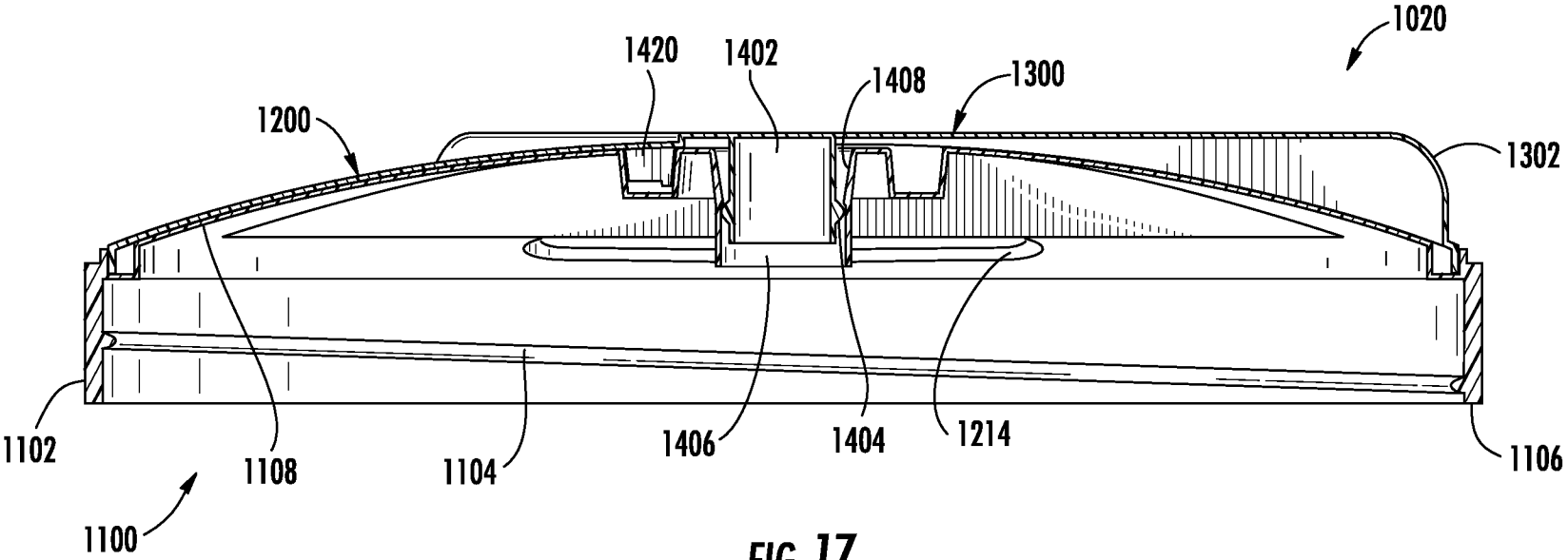
FIG. 17 is a cross sectional view of the closure of FIG. 16.

Referring to FIG. 17, body portion 1100 has a side wall 1102 (e.g., skirt, etc.) adapted to fit over an end of receptacle 1012. According to one exemplary embodiment, side wall 1102 is cylindrical in shape and has a coupling component (e.g., attachment structure), shown as threads 1104, located on an inside surface for engaging a corresponding coupling component (e.g., threads, etc.) on receptacle 1012 to secure closure 1020 to the open end of receptacle 1012. According to the various alternative embodiments, the coupling component may be any known or otherwise suitable structure (e.g., press-on rings or snap-fit structure, ribs, etc.) for coupling closure 1020 to receptacle 1012. Side wall 1102 is also shown as including a gripping surface 1110 (e.g., a textured area, serrated area, ribs, etc.) that is intended to facilitate gripping by a user for rotating or otherwise moving body portion 1100 and/or closure 1020 relative to receptacle 1012. According to the embodiment illustrated, gripping surface 1110 includes a plurality of vertical indentations (e.g. knurling or the like) that are adjacently spaced substantially around the entire periphery of side wall 1102. According to an exemplary embodiment, the vertical indentations may be integrally molded into side wall 1102.

Figure 16:
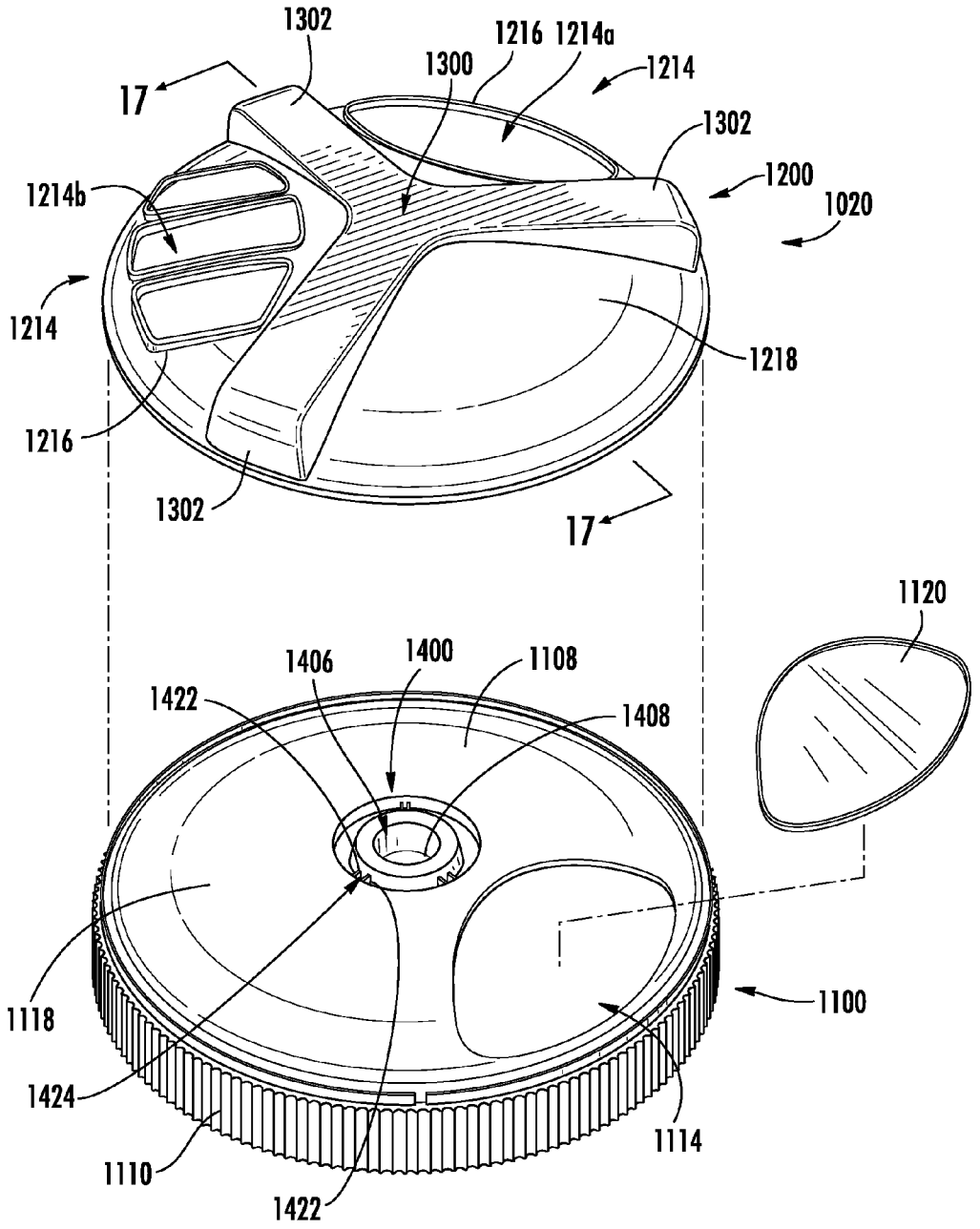
FIG. 16 is an exploded perspective view of the closure of FIG. 16.

Body portion 1100 also includes end wall 1108 which is shown as being slightly dome-shaped and oriented substantially perpendicular to a central axis of side wall 102. According to an exemplary embodiment, end wall 1108 and side wall 1102 are integrally formed as a single unitary body in a single mold by an injection molding operation to form body portion 1100. According to the various alternative embodiments, end wall 1108 and side wall 1102 may be formed separately and may be coupled together in any known or otherwise suitable manner (e.g., snap-fit, adhesive, welding, etc.). Referring further to FIG. 16, end wall 1108 includes at least one body dispensing aperture 1114 (e.g. opening, mouth, etc.), and the remaining portion of end wall 1108 provides a closed barrier 1118. According to an exemplary embodiment, a seal 1120 may be provided across body dispensing aperture 1114 to seal the contents of the container 1010 until ready for removal and use by a consumer.

Referring further to FIGS. 14-17, cover 1200 is also slightly dome-shaped to correspond with the end wall 1108 and further includes one or more cover dispensing apertures 1214, shown by way of example as two cover dispensing apertures 1214*a* and 1214*b*, and corresponding generally to the shape, size, spacing and position of the body dispensing aperture 1114 such that the body dispensing aperture 1114 and the cover dispensing apertures 1214 may be selectively rotated into registry with one another when the body 1100 and cover 1200 are assembled to form the closure 1020. According to an exemplary embodiment, cover 1200 may also include a lip 1216 surrounding the cover dispensing apertures 1214. Lip 1214 is intended to channel or divert any fluids or liquids (e.g. condensation, rainwater, etc.) on cover 1200 around and away from cover dispensing apertures 1214. According to the illustrated embodiment of FIGS. 14-17, two cover dispensing apertures 1214*a* and 1214*b* are provided and the remaining portion of the cover 1200 provides a closed barrier.

Cover 1200 is intended to be coupled to body 1100 at a pivot mechanism 1400 (see FIGS. 16 and 17) to form the closure 1020, with the central regions of the body 1100 and cover 1200 axially interlocked, but with the cover 1200 configured for rotational movement relative to body 1100 between a closed position and one or more open dispensing positions. The cover may be rotated to a first dispensing position with a first cover dispensing aperture 1214*a* (shown as a generally open mouth corresponding to a "pour" position) being substantially aligned with the body dispensing aperture 1114 (shown as a corresponding generally open mouth). The cover may also be rotated to a second dispensing position with a second cover dispensing aperture 1214*b* (shown as a having multiple sub-apertures separated by dividers (e.g. ribs, etc.) corresponding to a shake or a "shake-pour" position) being substantially aligned with the body dispensing aperture 1114.

Referring further to FIGS. 14-17, the ability to impart a rotational movement of cover 1200 relative to body 1100 is facilitated by a user interface, shown as a handle 1300, that is provided on cover 1200. According to an exemplary embodiment, handle 1300 comprises one or more segments 1302 (e.g. projections, lobes, etc.) extending radially from a shared central axis of cover 1200 and the body 1100. The amount of matter dispensed from the closure 1020 can be adjusted by rotating the cover to align with the desired dispensing apertures. According to an exemplary embodiment, cover 1200 and body 1100 are formed in a convex or dome shape in a closely nesting relationship (shown in FIG. 17) when the cover 1200 is in both the dispensing position and the closed position.

Referring to FIGS. 16 and 17, an interface for rotationally coupling the cover 1200 to the body 1100 (shown as a pivot mechanism 1400) is shown according to an exemplary embodiment. Cover 1200 includes a downwardly extending projection 1402 (e.g. post, axle, pivot, etc.) having a circumferential ridge 1404 (e.g. rib, barb, etc.) configured to be received within a bore 1406 (e.g. cylindrical opening, hole, etc.) formed in end wall 1108 for rotational movement of cover 1200 relative to body 1100 in a close-fitting relationship (shown schematically in FIG. 17). Projection 1402 is shown schematically as a circular post and includes a keeper (e.g. annular projection, barb, rib, etc.) shown schematically as a circumferential ridge 1404, or other suitable structure to permit the central regions of the cover 1200 to be axially interlocked with the end wall 1108 in a manner that permits rotational movement. Bore 1406 also includes a mating keeper (e.g. annular projection, barb, rib, etc.) shown schematically as a circumferential ridge 1408, which is configured to engage ridge 1404 in an axial interference manner to a rotatable snap-fit connection.

Referring further to FIGS. 16 and 17, inter-engaging structure are provided on the body 1100 and cover 1200 to provide cover indexing or positioning stops as the cover 1100 is rotated to/from the dispensing positions and the closed position, according to an exemplary embodiment. An underside of cover 1100 includes projections, shown as tabs 1420 that are arranged to correspond with each of the cover dispensing apertures 1214 and the cover barrier portion 1218 at which a position stop is desired. A top side of the end wall 1108 includes correspondingly positioned receptacles (e.g. recesses, pockets, etc.), shown by way of example as a gap 1424 between two parallel projections 1422 on end wall 1108. When the cover 1200 is rotatably coupled to the body 1100 at the pivot connection 1400 and rotated toward either a dispensing position or a closed position, the tabs 1420 approach the parallel projections 1422 in an interference type manner as previously described with reference to FIG. 10. As additional rotational force is applied to the cover 1200, the tab 1420 (and/or the cover 1200) resiliently flex a sufficient amount for the tab 1420 to ride over the projection 1422 (as described with reference to FIG. 11) and then be captured within the gap 1424 between the projections 1422, which corresponds to a position of axial alignment of the body dispensing aperture and one of the cover dispensing aperture or the cover barrier portion, until a sufficient rotational force is applied to the cover 1200 to move the tab 1422 out of the gap 1424 and to a new position. According to one embodiment, the operation of the position stops provides both a tactile (e.g. detent, etc.) indication and an audible indication (e.g. click, etc.) to provide additional feedback to a user that the cover and body have been aligned in a desired position.

Referring now to FIGS. 18-20, closure 2020 is shown according to another exemplary embodiment. Closure 2020 is similar in many respects to closures 20 and 1020 and any description provided herein with respect to closures 20 and 1020 may apply accordingly to the features of closure 2020. In addition to the features described herein in relation to closures 20 and 1020, the closure 2020 may include features to facilitate stacking of two or more closures 2020 or associated receptacles on top of each other, as well as features to facilitate dispensing the contents of an associated container via closure 2020. Similar to the closures 20 and 1020, closure 2020 is shown in FIGS. 18-20 as generally including a body portion 2100 (e.g., base, bottom, etc.) and a cover portion 2200 (e.g., lid, dial, top, etc.). Closure 2020 is configured to fit over a mouth of a receptacle 2012 to form container 2010.

Referring to FIGS. 18 and 19, the body 2100 is similar to body 100 and 1100. Body 2100 includes a side wall 2102 (e.g., skirt, etc.) adapted to fit over an end of receptacle 2012. Side wall 2102 is cylindrical in shape and may include a coupling component (e.g., attachment structure) similar to threads 1104 for engaging a corresponding coupling component (e.g., threads, etc.) on receptacle 2012 to secure closure 2020 to an open end of receptacle 2012. Although side wall 2102 is shown to have a smooth outer surface in the illustrated embodiment, side wall 2102 may also include a gripping surface such as surface 1110 in other embodiments.

Body 2100 also includes end wall 2108 which is shown in FIG. 19 as being slightly dome-shaped and oriented substantially perpendicular to a central axis 2104 of side wall 2102. According to an exemplary embodiment, end wall 2108 and side wall 2102 are integrally formed as a single unitary body in a single mold by an injection molding operation to form body 2100. According to the various alternative embodiments, end wall 2108 and side wall 2102 may be formed separately and may be coupled together in any known or otherwise suitable manner (e.g., snap-fit, adhesive, welding, etc.). End wall 2108 includes at least one body dispensing aperture 2114 (e.g. opening, mouth, etc.) at least partially defined by lip 2116. End wall 2108 also includes raised body portions 2112 configured to engage dispensing apertures of cover 2200 to provide closed barriers 2118 for the contents of the container 2010.

Referring further FIGS. 18 and 19, the side wall 2102 extends from a bottom edge 2106 to a top edge forming ledge 2204. The ledge 2204 may connect the side wall 2102 and the end wall 2108. The ledge 2204 has a circular shape similar to the shape of the side wall 2102. The ledge 2204 extends around the perimeter of the end wall 2108, having a diameter larger than the diameter of the end wall 2108. The ledge 2204 may be intended to receive a side wall (e.g., side wall 2102) of another closure such as closure 2020 in order to stack two or more of the closures 2020 for stocking or other storage purposes. When two or more closures 2020 are stacked on top of each other, the bottom edge of a first closure rests on a ledge of a second closure. The ledge 2204 is positioned below the end wall 2108 according to the upright orientation of FIG. 19 in order to retain the bottom edge 2106 of the body 2100 at the ledge 2204 and below the end wall 2108 when two or more of the closures 2020 are stacked. The ledge 2204 and the bottom edge 2106 of the side wall 2102 may also have a similar width in order to facilitate stacking two or more of the closures 2020. The ledge 2204 may similarly be utilized to stack two or more body portions 2100 when the body portions 2100 are decoupled from their associated cover portions 2200. The ledge 2204 may also be utilized to stack the receptacle 2012 on top of the closure 2020. For instance, the ledge 2204 may be configured to receive a bottom edge of the receptacle 2012 in order to stack two or more of the containers 2010. In such an embodiment, the ledge 2204 may correspond generally to the shape or size of the receptacle 2012 to facilitate stacking of two or more of the containers 2010.

Referring further to FIGS. 18-20, the cover 2200 is also slightly dome-shaped to correspond with the end wall 2108 and further includes a plurality of raised cover portions shown by way of example as cover dispensing apertures 2210 and 2220, and cover barrier portion 2240. In the illustrated embodiment of FIGS. 18-20, the cover dispensing apertures 2210 and 2220 correspond generally to the shape, size, spacing and position of the body dispensing aperture 2114 such that the body dispensing aperture 2114 and the cover dispensing apertures 2210 and 2220 may be selectively rotated into registry with one another when the body 2100 and cover 2200 are assembled to form the closure 2020. According to an exemplary embodiment, cover 2200 may also include lips 2212 and 2222 surrounding the cover dispensing apertures 2210 and 2220, respectively. Lips 2212 and 2222 are intended to channel or divert any fluids or liquids (e.g. condensation, rainwater, etc.) on cover 2200 around and away from the cover dispensing apertures 2210 and 2220, respectively. According to the illustrated embodiment of FIGS. 18-20, two cover dispensing apertures 2210 and 2220 and the cover barrier portion 2240 is configured to align with the body dispensing aperture 2114 to provide a closed barrier for the product within the receptacle 2012.

Cover 2200 is intended to be coupled to body 2100 at a pivot mechanism 2400 (see FIG. 19) to form the closure 2020, with the central regions of the body 2100 and cover 2200 axially interlocked, but with the cover 2200 configured for rotational movement relative to body 2100 between a closed position and one or more open dispensing positions. The cover 2200 may be rotated to a first dispensing position with the first cover dispensing aperture 2210 (shown as a generally open mouth corresponding to a "pour" position) being substantially aligned with the body dispensing aperture 2114 (shown as a corresponding generally open mouth). The cover 2200 may also be rotated to a second dispensing position with the second cover dispensing aperture 2220 being substantially aligned with the body dispensing aperture 2114.

As shown in FIGS. 19 and 20, the cover dispensing aperture 2220 includes multiple sub-apertures 2230 separated by dividers 2224 (e.g. ribs, etc.) corresponding to a shake or a "shake-pour" position. The dividers 2224 are substantially flat at a top surface 2228 and extend between the sub-apertures 2230 so that any product poured from the cover dispensing aperture 2220 is not "trapped" between the sub-apertures 2230 or otherwise to limit the collection of the product between the sub-apertures 2230. For instance, any product remaining between the sub-apertures 2230 may collect on the flat top surface 2228 such that the product may be more easily wiped away or returned to the receptacle 2012.

As shown more particularly in FIG. 20, the dividers 2224 have a triangular shape such that each of the dividers 2224 extends from the flat top surface 2228 to form a projection 2226 (e.g., corner, edge, tip, point) at the bottom of the dividers 2224 (i.e., the portion facing the receptacle 2012). Each of the projections 2226 projects toward an open bottom of the body 2100 when the cover 2200 is coupled to the body 2100 (i.e., toward the receptacle 2012 when the closure 2020 is coupled to the receptacle 2012 to form the container 2010). The projections 2226 are intended to break up any large clumps of product as the product is poured through the sub-apertures 2230 of the cover dispensing aperture 2220. For instance, smaller granules of the product may become stuck together in the receptacle 2012 when the product is not in use. The projections 2226 are intended to break apart any larger portions of the product that have been stuck together so that the product is distributed as intended when the product is released from the container 2010 through the cover dispensing aperture 2220. The projections 2226 are also configured to divert product from the dividers 2224 through the sub-apertures 2230 when the cover 2200 is in the dispensing position (i.e., when the cover dispensing aperture 2210 is substantially aligned with the body dispensing aperture 2114).

The projections 2226 may also be configured to collect any product remaining on the end wall 2108 or otherwise on the body 2100 as the cover 2200 is rotated relative to the body 2100. In an example embodiment, at least one of the projections 2226 extends to contact the raised body portions 2112 (e.g., closed barriers 2118) when the cover 2200 is rotated relative to the body 2100 to move the cover dispensing aperture 2220 over the raised body portions 2112. One or more of the projections 2226 may also extend to contact the lip 2116 when the cover 2200 is rotated relative to the body 2100 to move the cover dispensing aperture 2220 over the body dispensing aperture 2114. For instance, the projections 2226 may be configured to collect any product remaining on the lip 2116 and deposit the product through the body dispensing aperture 2114 and the open bottom of the body 2100 as the cover dispensing aperture 2220 rotates over the body dispensing aperture 2114. In other embodiments, one or more of the projections 2226 may be configured to extend to the end wall 2108 in order to collect any remaining product and deposit the product into the receptacle 2012 via the body dispensing aperture 2114 as the cover 2200 is rotated relative to the body 2100.

Referring further to FIGS. 18-20, the ability to impart a rotational movement of cover 2200 relative to body 2100 is facilitated by a user interface, shown as a handle 2300, that is provided on cover 2200. According to an exemplary embodiment, handle 2300 comprises one or more segments 2302 (e.g. projections, lobes, etc.) extending radially from a shared central axis 2104 of cover 2200 and the body 2100. The segments extend between each of the cover dispensing apertures 2220 and 2210 and the cover barrier portion 2240 (e.g., raised cover portion). The amount of matter dispensed from the closure 2020 can be adjusted by rotating the cover 2200 (e.g., via the handle 2300) to align the desired cover dispensing aperture 2220 or 2210 with the body dispensing aperture 2114. According to an exemplary embodiment, cover 2200 and body 2100 are formed in a convex or dome shape in a closely nesting relationship when the cover 2200 is in both the dispensing position and the closed position.

The handle 2300 also includes features to facilitate stacking two or more closures 2020 or containers 2010. For instance, each of the segments 2302 is shown to include one or spacers (e.g., projections, bosses, etc.) shown as bumps 2304 to facilitate stacking of closures 2020 or containers 2010 one atop another. The bumps 2304 are configured to engage the bottom of receptacle 2012 when a second container is stacked on top of the cover 2200. The bumps 2304 are raised relative to the remainder of the handle 2300 (e.g., a surrounding surface of the handle 2300) to meet a bottom surface of a stacked closure or container. The bumps 2304 are intended to limit wear to the handle 2300 due to a stacked container, including to protect the finish on end wall 2202, on a face of the handle 2300, and/or on another top face of the cover 2200 when two or more of the closures 2020 or the containers 2010 are stacked.

Each of the segments 2302 is also shown to include one or more grooves 2306 (e.g., depressions, indentations, pockets, dimples, etc.) configured to receive a corresponding feature of a second container or closure to facilitate stacking of two or more containers 2010 or closures 2020. The grooves 2306 may be sized or shaped similarly to the corresponding feature in order to retain the corresponding feature within the grooves 2306 and thus limit movement (e.g., relative rotation or lateral movement) of a second closure or container when stacked upon the cover 2200. In an example embodiment, the grooves 2306 are located equidistant from the central axis 2104 and configured to receive a circular feature of a stacked container having a radius approximately equal to the distance between the central axis 2104 and a feature of the groove 2306. The segments 2302 are also shown to include a lip 2310 formed at least partially by the groove 2306 and intended to retain a corresponding feature of a stacked container. Each of the segments 2302 is also shown to include side walls 2308 forming the segments 2302. The side walls 2308 may also be sized or shaped to engage a corresponding feature of a stacked closure or container to limit a relative movement.

Referring to FIGS. 19 and 20, an interface for rotationally coupling the cover 2200 to the body 2100 (shown as a pivot mechanism 2400) is shown according to an exemplary embodiment. Cover 2200 includes a downwardly extending projection 2402 (e.g. post, axle, pivot, etc.) having a circumferential ridge 2404 (e.g. rib, barb, etc.) configured to be received within a bore 2406 (e.g. cylindrical opening, hole, etc.) formed in end wall 2108 for rotational movement of cover 2200 relative to body 2100 in a close-fitting relationship. Projection 2402 is shown as a circular or spherical post and includes a keeper (e.g. annular projection, barb, rib, etc.) shown as a circumferential ridge 2404, or other suitable structure to permit the central regions of the cover 2200 to be axially interlocked with the end wall 2108 in a manner that permits rotational movement. Bore 2406 also includes a mating keeper (e.g. annular projection, barb, rib, etc.) shown as a circumferential ridge 2408, which is configured to engage ridge 2404 in an axial interference manner to a rotatable snap-fit connection.

Referring further to FIGS. 19 and 20, inter-engaging structure are provided on the body 2100 and cover 2200 to provide cover indexing or positioning stops as the cover 2100 is rotated to/from the dispensing positions and the closed position, according to an exemplary embodiment. An underside of cover 2200 (shown in FIG. 20) includes projections, shown as tabs 2420 that are arranged to correspond with each of the cover dispensing apertures 2210 and 2220 and the cover barrier portion 2240 at which a position stop is desired. A top side of the end wall 2108 includes correspondingly positioned receptacles (e.g. recesses, pockets, etc.), shown by way of example as a gap 2424 between two parallel projections 2422 on end wall 2108. When the cover 2200 is rotatably coupled to the body 2100 at the pivot connection 2400 and rotated toward either a dispensing position or a closed position, the tabs 2420 approach the parallel projections 2422 in an interference type manner as previously described with reference to FIG. 10. As additional rotational force is applied to the cover 2200, the tab 2420 (and/or the cover 2200) resiliently flexes a sufficient amount for the tab 2420 to ride over the projection 2422 (as described with reference to FIG. 11) and then be captured within the gap 2424 between the projections 2422, which corresponds to a position of axial alignment of the body dispensing aperture 2114 and one of the cover dispensing apertures 2210 or 2220 or the cover barrier portion 2240, until a sufficient rotational force is applied to the cover 2200 to move the tab 2420 out of the gap 2424 and to a new position. According to one embodiment, the operation of the position stops provides both a tactile (e.g. detent, etc.) indication and an audible indication (e.g. click, etc.) to provide additional feedback to a user that the cover 2200 and body 2100 have been aligned in a desired position.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the subject matter as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is important to note that the construction and arrangement of the elements of the closure for a container provided in this specification are illustrative only. Although only a few exemplary and alternative embodiments of the present invention have been described in detail in this disclosure, those skilled in the art who review this disclosure will readily appreciate that many modifications are possible in these embodiments (such as variations in features such as orientation of raised portions, skirts and dispensing apertures; variations in sizes, structures, shapes, dimensions and proportions of the raised portions, recesses, lips, dispensing apertures, skirts, dispensing position stops and other elements; variations in the pivot mechanism configuration, use of materials, colors, combinations of shapes, etc.) without materially departing from the novel teachings and advantages of the disclosure. For example, the closure may be adapted and sized for use on any type of receptacle, or for use on receptacles of different sizes, and/or the closure may be used for dispensing a variety of different materials or contents. The body may be adapted for use on a receptacle with a square, rectangular, or other shaped mouth or opening, or the dispensing openings may be replaced with more than one opening (e.g., a tear-drop, triangular, rectangular, circular, oval, or other shaped openings) and be configured to pour one or more of a variety of different materials. According to other alternative embodiments, the closure may be adapted for coupling to a receptacle by a threaded interface or by a snap-on ring or other press-fit engagement structure. It is readily apparent that each of the different embodiments and elements of the closure may be provided in a wide variety of shapes, sizes, thicknesses, combinations, etc. It is also readily apparent that the interfaces and structures for sealing and/or retaining the cover on the body may be designed with any profile and configuration suitable for securing the cover to the body. Accordingly, all such modifications are intended to be within the scope of the inventions as defined in any appended claims.

The order or sequence of any process or method steps may be varied or re-sequenced according to alternative embodiments. In any claims, any means-plus-function clause is intended to cover the structures described herein as performing the recited function and not only structural equivalents but also equivalent structures. Other substitutions, modifications, changes and omissions may be made in the design, operating configuration and arrangement of the exemplary and other alternative embodiments without departing from the spirit of the present disclosure as expressed in any appended claims.

What is claimed is:

1. A closure configured to fit over a mouth of a receptacle to form a container, the closure comprising:

a body having an open bottom formed of a skirt that defines an outer periphery of the body and an end wall defining a body dispensing aperture and a raised body portion providing a closed barrier; and a cover coupled to the end wall of the body and having a cover dispensing aperture, the cover being rotatably movable relative to the body between a dispensing position with the cover dispensing aperture substantially aligned with the body dispensing aperture, and a closed position with the cover dispensing aperture substantially aligned with the raised body portion, wherein the cover dispensing aperture includes one or more dividers dividing the cover dispensing aperture into sub-apertures, and wherein each of the one or more dividers includes a flat top surface and extends away from the flat surface to form a pointed bottom edge that projects toward the open bottom of the body.

2. The closure of claim 1, wherein the flat top surface of the one or more dividers extends between each of the sub-apertures to limit the collection of product between the sub-apertures.

3. The closure of claim 1, wherein the pointed bottom edge of the one or more dividers extends to contact the raised body portion when the cover is rotated relative to the body to move the cover dispensing aperture over the raised body portion.

4. The closure of claim 1, wherein the body dispensing aperture is defined by a lip, and wherein the pointed bottom edge of the one or more dividers extends to contact the lip when the cover is rotated relative to the body to move the cover dispensing aperture over the body dispensing aperture.

5. The closure of claim 4, wherein the pointed bottom edge is configured to collect any product remaining on the lip of the body dispensing aperture and deposit the product through the body dispensing aperture and the open bottom as the cover dispensing aperture rotates over the body dispensing aperture.

6. The closure of claim 1, wherein the pointed bottom edge of the one or more dividers is configured to divert product from the one or more dividers through the sub-apertures when the cover is in the dispensing position.

7. The closure of claim 1, wherein the cover includes a handle configured to facilitate movement of the cover between the dispensing position and the closed position, wherein the handle includes segments extending from a central axis of the cover, and wherein each of the segments includes a groove configured to receive a corresponding feature of a stacked container.

8. A closure configured to fit over a mouth of a receptacle to form a container, the closure comprising:

a body having an open bottom formed of a skirt that defines an outer periphery of the body and an end wall defining a body dispensing aperture and a raised body portion providing a closed barrier; and a cover coupled to the end wall of the body and including:

a cover dispensing aperture and a raised cover portion, the cover being rotatably movable relative to the body between a dispensing position with the cover dispensing aperture substantially aligned with the body dispensing aperture, and a closed position with the cover dispensing aperture substantially aligned with the raised body portion; and a handle configured to facilitate movement of the cover between the dispensing position and the closed position, wherein the handle includes segments extending from a central axis of the cover and between the cover dispensing aperture and the raised cover portion, and wherein each of the segments includes a groove configured to receive a corresponding feature of a stacked container.

9. The closure of claim 8, wherein each of the segments includes a bump configured to engage the bottom of a receptacle on a stacked container.

10. The closure of claim 9, wherein each of the bumps is raised relative to a surrounding surface of the segment to protect the surrounding surface from wear due to the stacked container.

11. The closure of claim 8, wherein the grooves are located equidistant from the central axis and configured to receive a circular feature of the stacked container having a radius approximately equal to the distance between the central axis and each of the grooves.

12. The closure of claim 8, wherein each of the segments includes a lip formed by the groove and intended to retain the corresponding feature of the stacked container.

13. The closure of claim 12, wherein the grooves are configured to retain the corresponding feature in order to limit movement of the stacked container relative to the cover.

14. The closure of claim 8, wherein the cover dispensing aperture includes one or more dividers defining sub-apertures, and wherein each of the one or more dividers includes a flat top surface and extends away from the flat surface to form a pointed bottom edge that projects toward the open bottom of the body.

15. A closure configured to fit over a mouth of a receptacle to form a container, the closure comprising:

a body having an open bottom formed of a skirt that defines an outer periphery of the body and an end wall defining a body dispensing aperture and a raised body portion providing a closed barrier; and a cover coupled to the end wall of the body and including:

a cover dispensing aperture, wherein the cover dispensing aperture includes one or more dividers dividing the cover dispensing aperture into sub-apertures, wherein each of the one or more dividers includes a flat top surface extending between the sub-apertures and extends away from the flat surface to form a pointed bottom edge that projects toward the open bottom of the body;

a raised cover portion, the cover being rotatably movable relative to the body between a dispensing position with the cover dispensing aperture substantially aligned with the body dispensing aperture, and a closed position with the cover dispensing aperture substantially aligned with the raised body portion and the raised cover portion substantially aligned with the body dispensing aperture; and a handle configured to facilitate movement of the cover between the dispensing position and the closed position, wherein the handle includes segments extending from a central axis of the cover and between the cover dispensing aperture and the raised cover portion, and wherein each of the segments includes a groove configured to receive a corresponding feature of a stacked container.

16. The closure of claim 15, wherein the pointed bottom edge of the one or more dividers extends to contact the raised body portion when the cover is rotated relative to the body to move the cover dispensing aperture over the raised body portion.

17. The closure of claim 15, wherein the body dispensing aperture is defined by a lip, and wherein the pointed bottom edge of the one or more dividers extends to contact the lip when the cover is rotated relative to the body to move the cover dispensing aperture over the body dispensing aperture.

18. The closure of claim 15, wherein the pointed bottom edge of the one or more dividers is configured to divert product from the one or more dividers through the sub-apertures when the cover is in the dispensing position.

19. The closure of claim 15, wherein each of the segments includes a bump configured to engage the bottom of a receptacle on a stacked container, and wherein each of the bumps is raised relative to a surrounding surface of the segment to protect the surrounding surface from wear due to the stacked container.

20. The closure of claim 15, wherein the grooves are located equidistant from the central axis and configured to receive a circular feature of the stacked container having a radius approximately equal to the distance between the central axis and each of the grooves.

* * * * *